US008276568B2

(12) United States Patent
Takagi et al.

(10) Patent No.: US 8,276,568 B2
(45) Date of Patent: Oct. 2, 2012

(54) FUEL SUPPLY APPARATUSES

(75) Inventors: Kunio Takagi, Obu (JP); Kazuhiko Nishimura, Obu (JP); Kazuhiro Yoneshige, Obu (JP); Satomi Wada, Obu (JP); Hiroki Endo, Obu (JP); Masaki Ikeya, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 217 days.

(21) Appl. No.: 12/278,469

(22) PCT Filed: Feb. 7, 2007

(86) PCT No.: PCT/JP2007/052094

§ 371 (c)(1),
(2), (4) Date: Aug. 26, 2008

(87) PCT Pub. No.: WO2007/097195

PCT Pub. Date: Aug. 30, 2007

(65) Prior Publication Data

US 2009/0071444 A1 Mar. 19, 2009

(30) Foreign Application Priority Data

Feb. 20, 2006 (JP) ..... 2006-42281
Aug. 3, 2006 (JP) ..... 2006-211968

(51) Int. Cl.
*F02M 37/00* (2006.01)

(52) U.S. Cl. ..... 123/511; 123/510; 123/512; 123/514; 123/516; 123/461; 123/458

(58) Field of Classification Search ..... 123/447, 123/457, 458, 461, 509, 510, 511, 512, 513
See application file for complete search history.

(56) References Cited

U.S. PATENT DOCUMENTS

| | | | | |
|---|---|---|---|---|
| 5,050,567 | A * | 9/1991 | Suzuki | 123/514 |
| 5,967,119 | A * | 10/1999 | Burkhard et al. | 123/458 |
| 6,802,333 | B2 * | 10/2004 | Balazy et al. | 137/110 |
| 2003/0047169 | A1 * | 3/2003 | Buse et al. | 123/457 |

FOREIGN PATENT DOCUMENTS

| | | |
|---|---|---|
| DE | 19 629891 | 1/1997 |
| JP | 57 052668 | 3/1982 |
| JP | 09 096262 | 4/1997 |
| JP | 09 177630 | 7/1997 |
| JP | 11 107874 | 4/1999 |
| JP | 2001 090624 | 4/2001 |
| JP | 2004 278394 | 10/2004 |
| JP | 2005 147037 | 6/2005 |

* cited by examiner

*Primary Examiner* — Willis R Wolfe, Jr.
*Assistant Examiner* — Anthony L Bacon
(74) *Attorney, Agent, or Firm* — Dennison, Schultz & MacDonald

(57) ABSTRACT

A fuel supply apparatus according to the present invention includes vapor production determining means for determining whether or not the vapor of the fuel is producible, and control means (ECU) for operating a passage resistance adjusting means of a pressure adjusting mechanism to cause increase of the pressure of the fuel supplied to an injector insomuch as the production of the vapor is inhibited when the vapor production determining means has determined a vapor producible condition.

12 Claims, 12 Drawing Sheets

FUEL SUPPLY APPARATUSES

TECHNICAL FIELD

The present invention relates to fuel supply apparatuses that include a fuel pump disposed within a fuel tank, and a pressure adjusting mechanism for adjusting the pressure of fuel discharged from the fuel pump, so that the fuel adjusted in pressure by the pressure adjusting mechanism is supplied to an injector of an engine.

BACKGROUND ART

Various apparatuses have been proposed as the above fuel supply apparatuses.

For example, a fuel supply apparatus 100 disclosed in Patent Document 1 includes a fuel tank 101 and a fuel pump 102 disposed within the fuel tank 101 as shown in FIG. 12. Fuel within the fuel tank 101 is pressurized by the fuel pump 102 and passes through a fuel filter 103, and thereafter, its pressure is adjusted to a predetermined pressure by a pressure adjusting mechanism 110, and the fuel is then supplied to each of injectors 105 via a branch pipe section 104. Then, the fuel is injected into each of cylinders (not shown) from each injector 105.

A pressure regulator 112 of the pressure adjusting mechanism 110 is provided with a diaphragm (not shown) that separates a control pressure chamber 112*c* and a fuel pressure adjusting chamber 112*f* from each other, and a valve body (not shown) for returning (releasing) the fuel within the fuel pressure adjusting chamber 112*f* to the inside of the fuel tank 101 is connected to the diaphragm. In addition, the pressure adjusting mechanism 110 has a pressure control valve 117 on the inlet side of the control pressure chamber 112*c* of the pressure regulator 112, and the pressure control valve 117 can open and close based on a signal from a control unit 120.

When the engine is started or in other occasions, the pressure adjusting mechanism 110 supplies the fuel into the control pressure chamber 112*c* by opening the pressure control valve 117, in order to increase the pressure within the control pressure chamber 112*c* by the pressure of the supplied fuel. This causes the diaphragm to be flexed and the valve body narrows the flow passage, so that flow passage resistance increases. As a result, the fuel pressure within the fuel pressure adjusting chamber 112*f* increases, and the fuel pressure within the branch pipe section 104 communicating with the fuel pressure adjusting chamber 112*f* increases. Thus, because the fuel pressure supplied to each injector 105 becomes high, atomization of the injected fuel is enhanced and the startability of the engine is improved. Further, after the engine has started, the pressure control valve 117 is closed to lower the pressure within the control pressure chamber 112*c*. This causes the diaphragm to flex in the opposite direction, so that the valve body broadens the flow passage to decrease the flow passage resistance. As a result, the fuel pressure within the fuel pressure adjusting chamber 112*f* decreases, and the fuel pressure within the branch pipe section 104 communicating with the fuel pressure adjusting chamber 112*f* decreases. Thus, because the fuel pressure supplied to each injector 105 becomes low, it is possible to reduce the load on the fuel pump 102, etc.

Patent Document 1: Japanese Laid-Open Patent Publication No. 2001-90624

The pressure adjusting mechanism 110 of the fuel supply apparatus 100 described above is configured to increase the pressure of the fuel supplied to each injector 105 in order to improve the startability of the engine. Therefore, it may be considered to quickly lower the pressure of the fuel after the engine has started. However, for example, when the engine is restarted on a high-temperature condition, vapor may be produced within the fuel due to decrease in the fuel pressure even after starting the engine, and therefore, there is a possibility that the amount of fuel injected from the injectors fluctuates to cause unstable idling rotational speed.

In addition, with the pressure adjusting mechanism 110 of the fuel supply apparatus 100 described above, in order to bring the fuel pressure supplied to the injectors 105 to be a high pressure, the pressure control valve 117 is opened for communicating the control pressure chamber 112*c* of the pressure regulator 112 and the outlet region of the fuel filter 103 with each other. Therefore, if the fuel pressure within the fuel pressure adjusting chamber 112*f* increases in response to the pressure within the control pressure chamber 112*c*, the fuel pressure within the fuel pressure adjusting chamber 112*f* is applied to the inside of the control pressure chamber 112*c* via the pressure control valve 117, resulting in increase of the pressure within the control pressure chamber 112*c*. Thus, the pressure within the control pressure chamber 112*c* gradually increases, and the fuel pressure within the fuel pressure adjusting chamber 112*f* increases in a proportional manner, so that the fuel pressure supplied to the injectors 105 increases.

Further, on the condition that the fuel is supplied into the control pressure chamber 112*c* of the pressure regulator 112 due to opening of the pressure control valve 117, i.e., on the condition that the diaphragm is flexed to narrow the flow passage by the valve body, for example, if the amount of flow rate of the fuel flowing through the flow passage of the valve body gradually increases, the valve body and the diaphragm move as the flow rate increases, and therefore, the fuel pressure within the control pressure chamber 112*c* and the fuel pressure adjusting chamber 112*f* increases. As a result, the pressure of the fuel supplied to each injector 105 increases.

Because the pressure of the fuel supplied to the injectors 105 affects the fuel injection performance of the injectors 105, fluctuation is not desirable.

Thus, there is a need in the art for fuel supply apparatuses that can inhibit fluctuation in amount of fuel injected from an injector, and to inhibit change of the fuel pressure when the pressure of fuel supplied to the injector is changed to a high pressure.

SUMMARY OF THE INVENTION

A first aspect of the present invention includes a fuel supply apparatus comprising a fuel pump located within a fuel tank, and a pressure adjusting mechanism for adjusting a pressure of a fuel discharged from the fuel pump, so that the fuel adjusted in pressure by the pressure adjusting mechanism is supplied to an injector of an engine, wherein the pressure adjusting mechanism comprises a fuel passage for introducing a part of the fuel pressurized by the fuel pump into a control pressure chamber and for returning the fuel flowing out of the control pressure chamber into the fuel tank, and passage resistance adjusting means for adjusting the passage resistance of the fuel passage and for increasing or decreasing the pressure within the control pressure chamber, so that the pressure of the fuel supplied to the injector is increased or decreased in response to increase or decrease in the pressure within the control pressure chamber, characterized in that the apparatus comprises:

vapor production determining means for determining whether or not a vapor of the fuel is producible; and control means for operating the passage resistance adjusting means of the pressure adjusting mechanism to cause increase of the pressure of the fuel supplied to the injector insomuch as the production of the vapor is inhibited when the vapor production determining means has determined a vapor producible condition.

According to this invention, it is possible to determine by the vapor production determining means whether or not a vapor of the fuel is producible. If the vapor producible condition has been determined, the control means operates the passage resistance adjusting means of the pressure adjusting mechanism to cause increase of the pressure of the fuel supplied to the injector insomuch as the production of the vapor is inhibited. Thus, even in the state where the vapor is producible, the production of vapor is inhibited by the increase of the fuel pressure. Hence, it is possible to inhibit change of amount of the fuel that is injected from the injector, and it is possible to stabilize the idling rotational speed of the engine.

A second aspect of the invention is characterized in that the vapor production determining means determines the vapor producible condition when a temperature of cooling water of the engine, a temperature within an intake air pipe, a temperature of the fuel, a temperature of an engine oil, or a temperature of the injector has increased to a set temperature.

A third aspect of the invention is characterized in that the vapor production determining means determines the vapor producible condition when the pressure within a fuel piping positioned proximal to the injector has increased to a set pressure.

A fourth aspect of the invention is characterized in that the vapor production determining means determines the vapor producible condition when a current value of a motor driving the fuel pump has lowered to be less than a predetermined value.

A fifth aspect of the invention is characterized in that the apparatus is constructed such that the fuel discharged from a vapor discharge hole formed with the midway of a pump passage of the fuel pump is introduced into the control pressure chamber of the pressure adjusting mechanism via the fuel passage.

Because of the construction of introducing the fuel discharged from the vapor discharge hole of the fuel pump into the control pressure chamber of the pressure adjusting mechanism, it is possible to reduce the workload on the fuel pump, for example, in comparison with the construction in which a part of the fuel discharged from a discharge port of the fuel pump is introduced into the control pressure chamber. Hence, the durability is improved if the construction of the fuel pump is the same.

A sixth aspect of the invention is characterized in that the apparatus is constructed such that a part of the fuel discharged from a discharge port of the fuel pump is introduced into the control pressure chamber of the pressure adjusting mechanism via the fuel passage.

A seventh aspect of the invention is characterized in that the passage resistance adjusting means includes a pressure control valve located on the outlet side of the control pressure chamber of the pressure adjusting mechanism; and the apparatus is constructed such that the pressure within the control pressure chamber increases as the pressure control valve of the pressure adjusting mechanism narrows a flow passage.

In this way, when the pressure of the control pressure chamber of the pressure adjusting mechanism is intended to be increased, the pressure adjusting mechanism narrows the flow passage on the outlet side of the control pressure chamber to increase the passage resistance, and therefore, the flow rate of the fuel supplied from the fuel pump to the pressure adjusting mechanism is reduced, so that it is possible to reduce the workload on the fuel pump. Hence, the durability of the fuel pump is improved.

In addition, when the apparatus is used on the condition that the pressure within the control pressure chamber of the pressure adjusting valve is low (normal condition), the pressure control valve of the passage resistance adjusting means serves to increase the flow passage area, and therefore, the flow rate of the fuel is increased, so that the aged fuel is hard to stay within the control pressure chamber An eighth aspect of the invention is characterized in that the passage resistance adjusting means includes a pressure control valve located on the inlet side of the control pressure chamber of the pressure adjusting mechanism and includes a throttle disposed on the outlet side of the control pressure chamber, and the apparatus is constructed such that the pressure within the control pressure chamber increases as the pressure control valve of the pressure adjusting mechanism opens a flow passage to reduce the passage resistance.

A ninth aspect of the invention is characterized in that a container for receiving the fuel pump and the pressure adjusting mechanism is located within the fuel tank at the bottom of the fuel tank, and fuel supply means is provided on the container for producing a flow of the fuel by causing the fuel discharged from the control pressure chamber of the pressure adjusting mechanism to flow into the container via an inlet of the container, and for causing the fuel within the fuel tank to flow into the container via the inlet by using the flow of the fuel. Hence, for the flow of the fuel within the fuel tank into the container, it is possible to effectively utilize the kinetic energy of the fuel that has flown out of the control pressure chamber of the pressure adjusting mechanism.

A tenth aspect of the invention includes a fuel supply apparatus comprising a fuel pump located within a fuel tank, and a pressure adjusting mechanism for adjusting a pressure of a fuel discharged from the fuel pump, so that the fuel adjusted in pressure by the pressure adjusting mechanism is supplied to an injector of an engine via a tank-outside fuel supply pipe; wherein:

the pressure adjusting mechanism comprises a fuel passage for introducing the fuel, which is pressurized by the fuel pump but is not supplied to the injector, into a control pressure chamber and for returning the fuel flowing out of the control pressure chamber into the fuel tank, passage resistance adjusting means for adjusting the passage resistance of the fuel passage, and a fuel pressure adjusting chamber communicating with the tank-outside fuel supply pipe;

the pressure adjusting mechanism is configured such that, by the action of the passage resistance adjusting means, when in the state where the fuel pressure within the control pressure chamber has increased to exceed a predetermined value, the fuel pressure within the fuel pressure adjusting chamber is brought to a high pressure corresponding to the fuel pressure within the control pressure chamber; and when in the state where the fuel pressure within the control pressure chamber has reduced to be lower than the predetermined value, the fuel pressure within the fuel pressure adjusting chamber is brought to a low pressure; and a relief valve is disposed in the control pressure chamber of the pressure adjusting mechanism or in the fuel passage communicating with the control pressure chamber for releasing a part of the fuel into the fuel tank when the fuel pressure has increased to exceed a set value over the predetermined value.

According to this invention, due to the action of the passage resistance adjusting means, when the fuel pressure within the control pressure chamber has increased to exceed a predetermined pressure, the fuel pressure within the fuel pressure adjusting chamber, i.e., the pressure of the fuel supplied to the injector, is adjusted to a high pressure depending on the fuel pressure within the control pressure chamber. Here, on the condition that the fuel pressure has adjusted to a high pressure, the relief valve operates when the fuel pressure has increased to exceed the set value due to the influence of the fuel pressure within the fuel pressure adjusting chamber or the flow rate of the fuel flowing through a flow passage of a valve body as explained in Problems to be Solved by the Invention. Hence, a part of the fuel within the control pressure chamber is returned into the fuel tank via the relief valve, so that the fuel pressure within the control pressure chamber is maintained at the set value. The pressure adjusting mechanism adjusts the fuel pressure within the fuel pressure adjusting chamber depending on the fuel pressure within the control pressure chamber, and therefore, the fuel pressure within the fuel pressure adjusting chamber also is maintained at a fixed pressure because the fuel pressure within the control pressure chamber is maintained at the set value. Hence, the fuel pressure within the tank-outside fuel supply pipe communicating with the fuel pressure adjusting chamber (the pressure of the fuel supplied to the injector) is maintained at a fixed pressure. Thus, even in the case that the fuel pressure supplied to the injector is switched to a high pressure, the fuel pressure is hard to change, and therefore, the pressure adjusting performance is improved.

An eleventh aspect of the invention includes a fuel supply apparatus comprising a fuel pump located within a fuel tank, and a pressure adjusting mechanism for adjusting a pressure of a fuel discharged from the fuel pump, so that the fuel adjusted in pressure by the pressure adjusting mechanism is supplied to an injector of an engine via a tank-outside fuel supply pipe; wherein:

the pressure adjusting mechanism comprises a fuel passage for introducing the fuel, which is pressurized by the fuel pump but is not supplied to the injector, into a control pressure chamber and for returning the fuel flowing out of the control pressure chamber into the fuel tank, passage resistance adjusting means for adjusting the passage resistance of the fuel passage, and a fuel pressure adjusting chamber communicating with the tank-outside fuel supply pipe;

the pressure adjusting mechanism is configured such that, by the action of the passage resistance adjusting means, when in the state where the fuel pressure within the control pressure chamber has increased to exceed a predetermined value, the fuel pressure within the fuel pressure adjusting chamber is brought to a high pressure to correspond to the fuel pressure within the control pressure chamber; and when in the state where the fuel pressure within the control pressure chamber has reduced to be lower than the predetermined pressure, the fuel pressure within the fuel pressure adjusting chamber is brought to a low pressure; and a relief valve is disposed on the upstream side of the tank-outside fuel supply pipe for releasing a part of the fuel into the fuel tank when the fuel pressure has increased to exceed a set value.

According to this invention, due to the action of the passage resistance adjusting means, when the fuel pressure within the control pressure chamber has increased to exceed a predetermined pressure, the fuel pressure within the fuel pressure adjusting chamber, i.e., the pressure of the fuel supplied to the injector, is adjusted to a high pressure depending on the fuel pressure within the control pressure chamber. Here, on the condition that the fuel pressure has adjusted to a high pressure, the relief valve disposed on the upstream side of the tank-outside fuel supply pipe operates when the fuel pressure within the fuel pressure adjusting chamber and the tank-outside fuel supply pipe has increased to exceed a predetermined value in conjunction with increase of the fuel pressure within the control pressure chamber due to the influence of the fuel pressure within the fuel pressure adjusting chamber or the flow rate of the fuel flowing through a flow passage of a valve body as explained in Problems to be Solved by the Invention. Hence, a part of the fuel within the tank-outside fuel supply pipe is released into the fuel tank, so that the fuel pressure within the tank-outside fuel supply pipe, etc. (the pressure of the fuel supplied to the injector) is maintained at the set value. Thus, even in the case that the fuel pressure supplied to the injector is switched to a high pressure, the fuel pressure is hard to change, and therefore, the pressure adjusting performance is improved.

A twelfth aspect of the invention is characterized in that a throttle is provided in the fuel passage positioned on the upstream side of the control pressure chamber.

Therefore, it is possible to reduce the flow rate of fuel supplied to the control pressure chamber, i.e., the flow rate of the fuel that is returned to the fuel tank without being supplied to the injector, so that it is possible to reduce the load on the fuel pump.

A thirteenth aspect of the invention is characterized in that the fuel discharged from a vapor discharge hole formed in the midway of a pump passage of the fuel pump is introduced into the control pressure chamber via the fuel passage.

Because it is configured to introduce the fuel discharged from the vapor discharge hole into the control pressure chamber of the pressure adjusting mechanism, it is possible to reduce the workload on the fuel pump in comparison with the construction in which a part of the fuel discharged from a discharge port of the fuel pump is introduced into the control pressure chamber. Therefore, the durability is improved if the construction of the fuel pump is the same.

A fourteenth aspect of the invention is characterized in that a fuel supply passage for introducing the fuel discharged from the fuel pump into the tank-outside fuel supply pipe and for communicating with the fuel pressure adjusting chamber of the pressure adjusting mechanism is formed within a wall of a container that receives the pressure adjusting mechanism therein.

Therefore, the configuration of the pressure adjusting mechanism can be simplified because there is no need of pipe connection sections that may be required on the side of the pressure adjusting mechanism in the case that the fuel supply passage is formed by piping. In addition, the fuel supply apparatus becomes compact because no piping space is required around the pressure adjusting mechanism.

A fifteenth aspect of the invention is characterized in that the fuel pump is received within the container that receives the pressure adjusting mechanism therein.

Thus, the fuel supply apparatus becomes further compact because it is possible to store the pressure adjusting mechanism and the fuel pump within the same container and to form the associated flow passages integrally with the container.

EFFECTS OF THE INVENTION

According to the present invention, production of the vapor when the engine is at a high-temperature can be inhibited, and fluctuation of amount of the fuel injected from the injector can be inhibited. In addition, when the fuel pressure supplied to the injector is switched to a high pressure, the fuel pressure is hard to change, and therefore, the pressure adjusting performance is improved.

DESCRIPTION OF NUMERALS

| | |
|---|---|
| ECU | engine control unit (vapor production determining means, control means) |
| 3 | water temperature gauge (vapor production determining means) |
| 5 | injector |
| T | fuel tank |
| 7 | tank-outside fuel supply pipe |
| 25 | jet pump (fuel supply means) |
| 30 | fuel pump |
| 40 | pressure adjusting mechanism |
| 42 | pressure adjusting valve |
| 44 | pressure adjusting pipe |
| 45 | reflux flow supply pipe (fuel passage) |
| 45f | throttle (flow passage resistance adjusting means) |
| 46 | reflux flow return pipe (fuel passage) |
| 46f | throttle (flow passage resistance adjusting means) |
| 47 | pressure control valve (flow passage resistance adjusting means) |
| 11 | receiving container |
| 13k | reflux flow supply passage (fuel passage) |
| 13b | vapor discharge passage (fuel passage) |
| 13r | reflux flow return passage (fuel passage) |
| 14y | cut-out portion (fuel supply passage) |
| 15 | fuel supply passage |
| 16 | pressure adjusting valve receiving chamber |
| 16c | central upper chamber (fuel supply passage) |
| 16d | lower chamber (fuel passage) |
| 422 | fuel pressure adjusting chamber |
| 423 | control pressure chamber |
| 423s | coil spring (spring force = predetermined value) |

DETAILED DESCRIPTION OF THE INVENTION

Fuel supply apparatuses according to Embodiment 1 and Embodiment 2 of the present invention will now be described based on the drawings.

Embodiment 1

Figure 1:
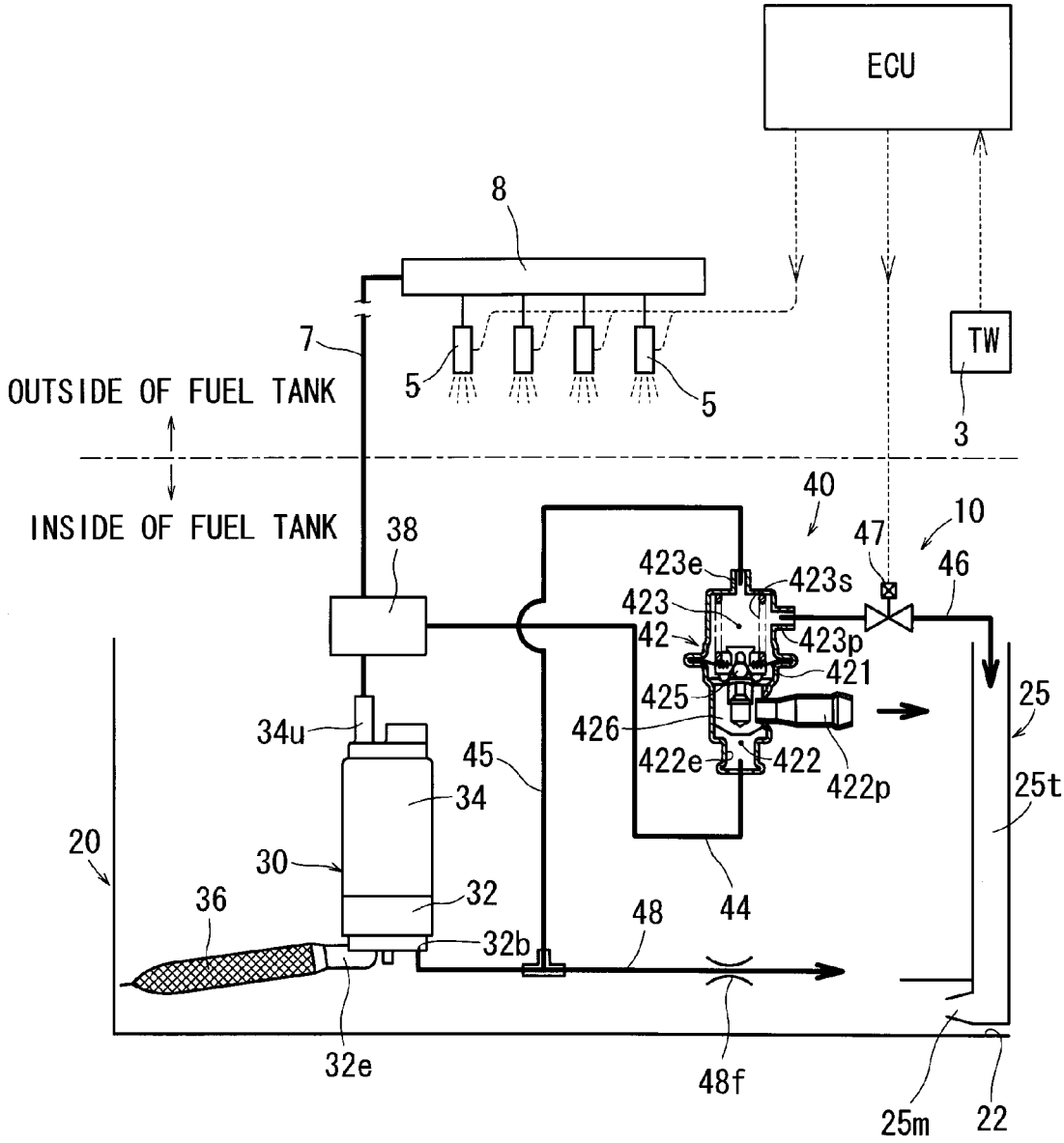
FIG. 1 This is a schematic view of a fuel supply apparatus according to the present invention (Embodiment 1).
Figure 2:
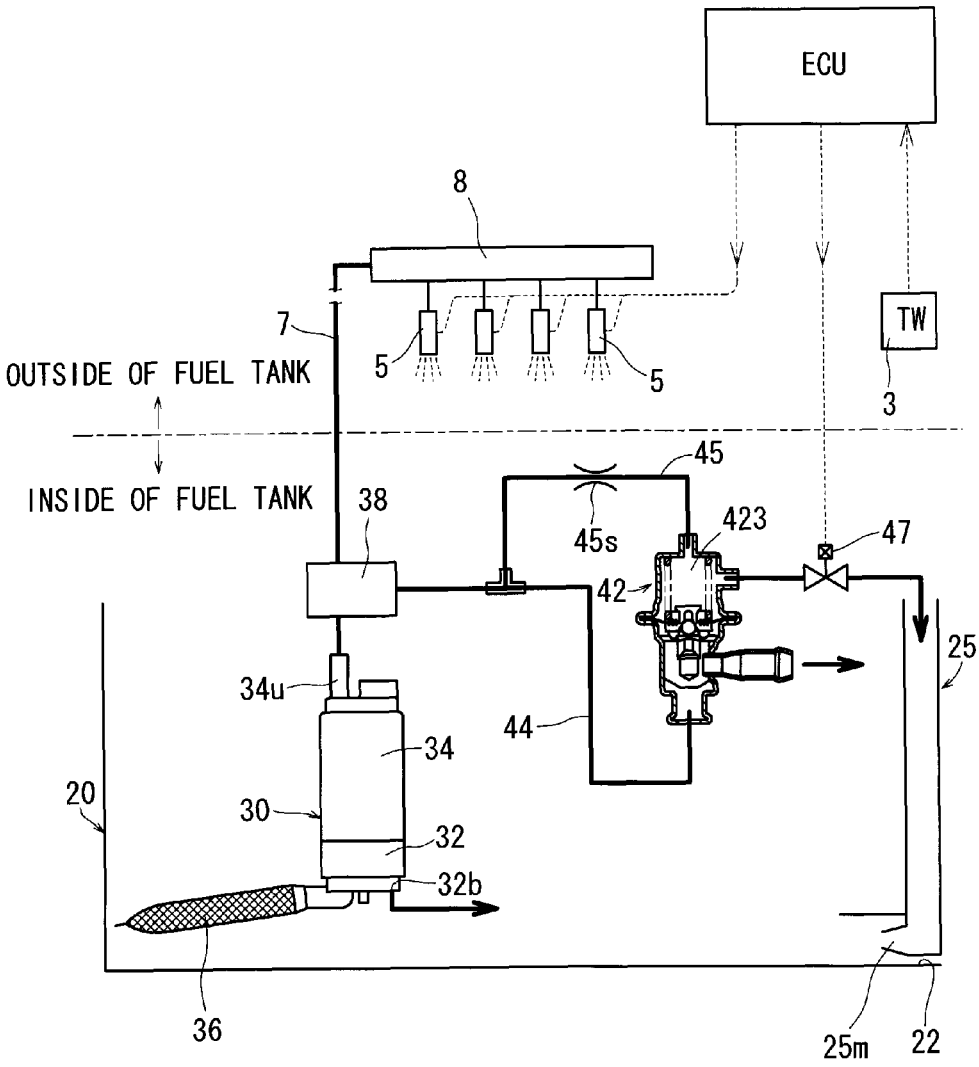
FIG. 2 This is a schematic view of a fuel supply apparatus according to an alternative example of the present invention (Embodiment 1).
Figure 3:
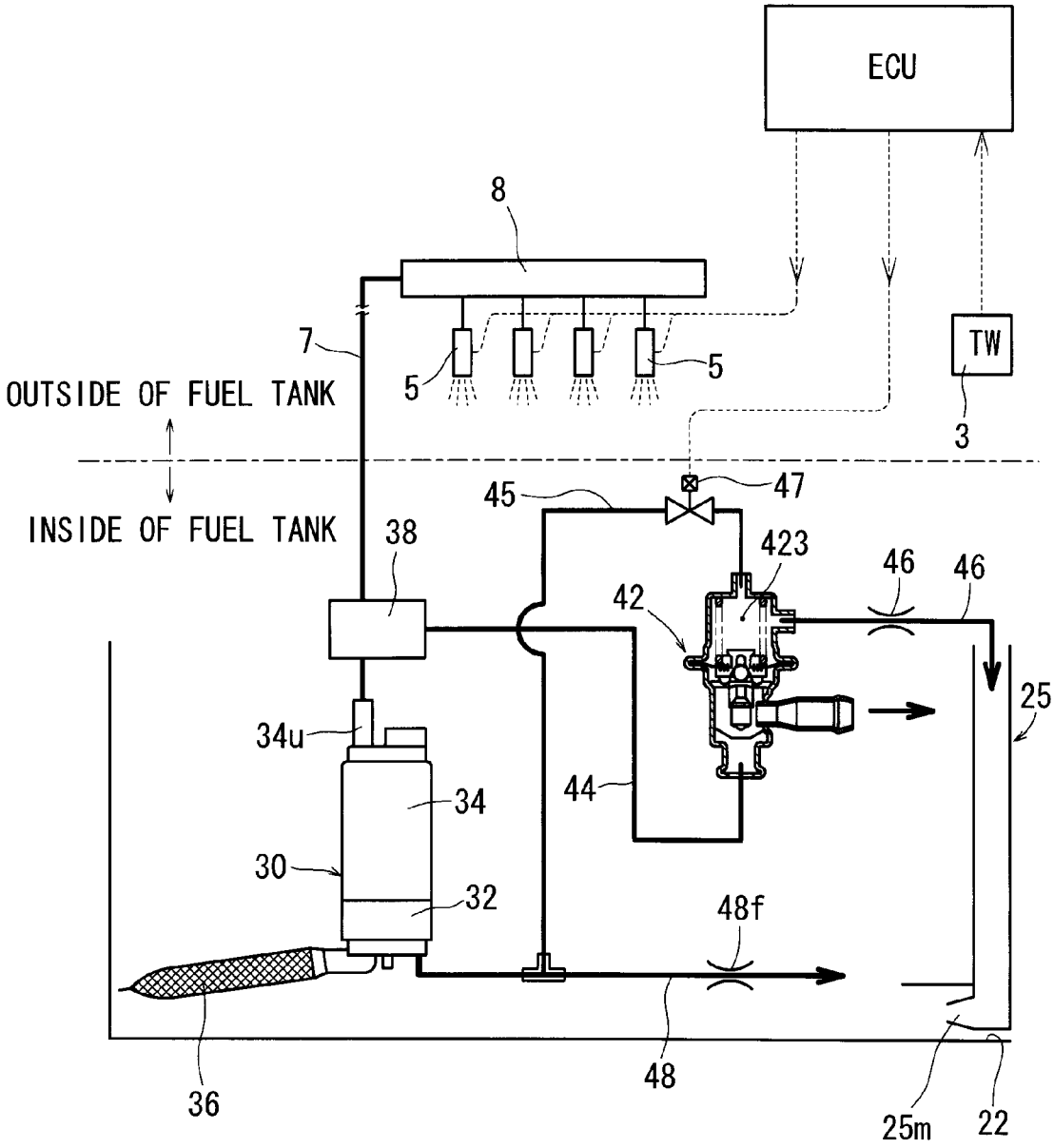
FIG. 3 This is a schematic view of a fuel supply apparatus according to an alternative example of the present invention (Embodiment 1).

The fuel supply apparatus according to Embodiment 1 of the present invention will now be described based on FIGS. 1 to 3. The fuel supply apparatus of this embodiment is that mounted to a fuel tank installed mainly on a vehicle, such as an automobile, etc., and a schematic view of the fuel supply apparatus is shown in FIG. 1. FIGS. 2 and 3 show alternative examples of the fuel supply apparatus shown in FIG. 1.

<With Regard to Overall Structure of Fuel Supply Apparatus 10>

The fuel supply apparatus 10 of this embodiment is an apparatus for feeding fuel (not shown) within a fuel tank to injectors 5 (fuel injection valves) of an engine at a predetermined pressure. As shown in FIG. 1, the fuel supply apparatus 10 operates based on a signal from an engine control unit ECU (hereinafter called ECU) and includes a water temperature gauge 3 for measuring a temperature of cooling water of the engine, a reservoir cup 20 configured as a top-open type container located at the bottom within the fuel tank, a fuel pump 30 received within the reservoir cup 20, a suction filter 36, a high-pressure filter 38, and a pressure adjusting mechanism 40.

The fuel pump 30 is a motor-integrated type pump including an impeller-type pump section 32 for drawing, pressurizing and discharging the fuel, and a motor section 34 for driving the pump section 32, and is installed such that the pump section 32 is positioned on the lower side and the motor section 34 is positioned on the upper side. The pump section 32 has a suction port 32*e* for drawing the fuel, and the suction filter 36 is attached to the suction port 32*e*. Therefore, the fuel within the reservoir cup 20 can be drawn into the pump section 32 from the suction port 32*e* via the suction filter 36. The fuel drawn into the pump section 32 from the suction port 32*e* is pressurized within a flow passage groove (not shown) by the rotation of the impeller (not shown) and is discharged into the motor section 34 from the discharge port (not shown). A vapor discharge hole 32*b* is formed with the flow passage groove of the pump section 32 at a midway position of the path from the suction port 32*e* to the discharge port for discharging the vapor in the fuel (i.e., gas bubbles that may be produced due to vaporization of the fuel) to the outside.

The fuel discharged into the motor section 34 from the pump section 32 cools within the motor section 34 as it flows therethrough upward, and at the same time, it lubricates and cleans the rotary portion, and is discharged from a pump discharge port 34*u* provided at the upper end. A high-pressure filter 38 is connected to the pump discharge port 34*u*, and motor-derived foreign materials, etc. contained in the fuel is captured by the high-pressure filter 38. After having filtered by the high-pressure filter 38, the fuel is adjusted to a predetermined pressure by the pressure adjusting mechanism 40, introduced into each of injectors 5 via a tank-outside fuel supply pipe 7 and a delivery pipe 8, and injected into combustion chambers (not shown) of the engine from injectors 5.

<With Regard to Pressure Adjusting Mechanism 40>

The pressure adjusting mechanism 40 serves to adjust the pressure of the fuel discharged from the fuel pump 30 (the fuel filtrated by the high-pressure filter 38) and also serves to return the surplus high-pressure fuel into the reservoir cup 20. The pressure adjusting mechanism 40 is provided with a pressure adjusting valve 42, a pressure adjusting pipe 44, a reflux flow supply pipe 45 and a reflux flow return pipe 46 connected to the pressure adjusting valve 42, and a pressure control valve 47 attached to the reflux flow return pipe 46.

The pressure adjusting valve 42 is provided with a control pressure chamber 423 and a fuel pressure adjusting chamber 422 separated from each other in a vertical direction by a diaphragm 421, and a valve section 426 disposed within the fuel pressure adjusting chamber 422. The fuel pressure adjusting chamber 422 is a chamber, into which the fuel that has been filtered by the high-pressure filter 38, is introduced, and includes an inlet port 422*e* disposed at the lower end and an outlet pipe 422*p* disposed on the side surface. In addition, the valve section 426 is disposed at the central position within the fuel pressure adjusting chamber 422 on the upstream side of the outlet pipe 422*p*. The valve section 426 includes a flow passage (not shown) communicating between the space within the fuel pressure adjusting chamber 422 and the outlet pipe 422*p* and is configured to open and close the flow passage by a valve body 425 mounted to the lower side of the center of the diaphragm 421. Therefore, if the force of pressing the diaphragm 421 from the side of the control pressure chamber 423 becomes larger than the force of pressing the diaphragm 421 from the side of the fuel pressure adjusting chamber 422, the diaphragm 421 is flexed downward and the valve body 425 moves downward, so that the flow passage area of the valve section 426 decreases. On the contrary, if the force of pressing the diaphragm 421 from the side of the control pressure chamber 423 becomes smaller than the force of pressing the diaphragm 421 from the side of the fuel pressure adjusting chamber 422, the diaphragm 421 is flexed upward and the valve body 425 moves upward, so that the flow passage area of the valve section 426 increases.

The control pressure chamber 423 of the pressure adjusting valve 42 is a chamber for adjusting the fuel pressure within the fuel pressure adjusting chamber 422 and is provided with an inlet port 423*e* disposed at the upper end and an outlet port 423*p* disposed at the side surface. In addition, a spring 423*s* is disposed within the control pressure chamber 423 for pressing the diaphragm 421 in an axial direction (downward) by a predetermined force.

The pressure adjusting pipe 44 for communicating between the outlet side of the high-pressure filter 38 and the fuel pressure adjusting chamber 422 is connected to the inlet port 422*e* of the fuel pressure adjusting chamber 422 of the pressure adjusting valve 42. In addition, the reflux flow supply pipe 45 for communicating between the vapor discharge pipe 48 and the control pressure chamber 423 is connected to the inlet port 423*e* of the control pressure chamber 423 of the pressure adjusting valve 42. The vapor discharge pipe 48 is a pipe that introduces the fuel discharged from the vapor discharge hole 32*b* of the fuel pump 30 to a predetermined position within the reservoir cup 20 and is provided with a throttle 48*f* disposed on the downstream side of a portion to which the reflux flow supply pipe 45 is connected. The narrowed area of the throttle 48*f* is determined to ensure the vapor discharge performance.

The reflux flow return pipe 46 is connected to the outlet port 423*p* of the control pressure chamber 423 of the pressure adjusting valve 42, and the downstream-side end of the reflux flow return pipe 46 is connected to a jet pump 25 (that will be described later) of the reservoir cup 20. A pressure control valve 47 is disposed at a midway position of the reflux flow return pipe 46.

The pressure control valve 47 is a valve operating by an electrical signal and operates by receiving a signal from the ECU to increase or decrease the flow passage area on the outlet side of the control pressure chamber 423 of the pressure adjusting valve 42.

The pressure of the fuel introduced from the vapor discharge hole 32*b* of the fuel pump 30 into the control pressure chamber 423 of the pressure adjusting valve 42 via the reflux flow return pipe 45 is adjusted to be a predetermined pressure by the action of the pressure control valve 47 and the throttle 48*f*.

Thus, the reflux flow supply pipe 45 and the reflux flow return pipe 46 correspond to the fuel passage according to the present invention, and the pressure control valve 47 corresponds to the flow passage resistance adjusting means according to the present invention.

<With Regard to Jet Pump 25>

The jet pump 25 is a pump that is adapted to cause the fuel within the fuel tank to flow into the reservoir cup 20 by using the flow of the fuel. The jet pump 25 is provided with a vertical passage portion 25*t* disposed vertically along a vertical wall of the reservoir cup 20 and is also provided with a nozzle portion 25*m* that is formed at the lower end of the vertical passage portion 25*t* so as to be oriented laterally and perpendicularly relative to the vertical passage portion 25*t*. The nozzle portion 25*m* of the jet pump 25 is inserted into a fuel inlet port 22 of the reservoir cup 20. Here, the inner diameter of the fuel inlet port 22 is set to be larger than the outer diameter of the nozzle portion 25*m*, and therefore, it is configured such that the nozzle portion 25*m* does not close the fuel inlet port 22. In addition, the aforementioned reflux flow return pipe 46 is connected to the upper end of the vertical passage portion 25*t*. Therefore, if the pressure control valve 47 is opened and the fuel within the control pressure chamber 423 of the pressure adjusting valve 42 is supplied to the jet pump 25, the fuel is supplied from the nozzle portion 25*m* to the fuel inlet port 22 of the reservoir cup 20 at a high flow speed. Then, it causes that the fuel within the fuel tank is drawn by the flow of the fuel and flows from the fuel inlet port 22 into the reservoir cup 20.

Thus, the jet pump 25 corresponds to the fuel supply means according to the present invention.

<Operation of Fuel Supply Apparatus 10>

The operation of the fuel supply apparatus 10 of this embodiment will now be described.

With the fuel supply apparatus 10 of this embodiment, if the cooling water temperature of the engine detected by the water temperature gauge 3 exceeds a predetermined temperature (set temperature, about 95° C.) at which vapor is produced in the fuel within the tank-outside fuel supply pipe 7 and the delivery pipe 8, the pressure control valve 47 of the pressure adjusting mechanism 40 is adjusted in a direction to narrow the flow passage based on a signal from the ECU. Hence, the passage resistance at the outlet port 423*p* of the control pressure chamber 423 of the pressure adjusting valve 42 increases to restrict the flow of the fuel out of the control pressure chamber 423. Here, the fuel discharged from the vapor discharge hole 32*b* of the fuel pump 30 is supplied to the control pressure chamber 423 of the pressure adjusting chamber 423 of the pressure adjusting valve 42 via the reflux flow supply pipe 45, and at the same time, it is discharged into the reservoir cup 20 via the vapor discharge pipe 48. However, because the discharge of the fuel is restricted by the throttle 48*f* disposed at the tip end (downstream-side end) of the vapor discharge pipe 48, the fuel pressure within the control pressure chamber 423 of the pressure adjusting valve 42 increases to a predetermined pressure that is determined by the pressure of the fuel discharged from the vapor discharge pipe 48 and the flow passage areas of the throttle 48*f* and the pressure control valve 47. Hence, the diaphragm 421 is flexed downward and the valve body 425 attached to the diaphragm 421 causes decrease in the flow passage area of the valve section 426. Thus, the outlet port of the fuel pressure adjusting chamber 422 of the pressure adjusting valve 42 is narrowed to cause increase in the passage resistance, so that the fuel pressure within the fuel pressure adjusting chamber 422 increases.

Here, the fuel pressure adjusting chamber 422 of the pressure adjusting valve 42 communicates with the pump discharge port 34*u* of the fuel pump 30 and the tank-outside fuel supply pipe 7 via the pressure adjusting pipe 44 and the high-pressure filter 38. Therefore, the pressure of the fuel that has discharged from the pump discharge port 34*u* of the fuel pump 30 and has passed through the high-pressure filter 38 (the pressure-fed fuel pressure of the fuel supply apparatus 10) becomes substantially equal to the fuel pressure within the fuel pressure adjusting chamber 422 of the pressure adjusting valve 42. Then, if the fuel pressure within the fuel pressure adjusting chamber 422 of the pressure adjusting valve 42 increases to cause the force pressing the diaphragm 421 from below to become larger than the force pressing the diaphragm 421 from above (from the side of the control pressure chamber 423), the diaphragm 421 is flexed upward. Hence, the valve body 425 moves upward and the flow passage area of the valve section 426 increases to reduce the passage resistance, so that the fuel pressure within the fuel pressure adjusting chamber 422 decreases.

Because the flow passage area of the valve section 426 is adjusted by the actions of the diaphragm 421 and the valve body 425 in this way, the passage resistance is adjusted and the fuel pressure within the fuel pressure adjusting chamber 422 and the pressure-fed fuel pressure of the fuel supply apparatus 10 is controlled to a predetermined pressure corresponding to the fuel pressure within the control pressure chamber 423 of the pressure adjusting valve 42.

Here, with the fuel supply apparatus 10 according to this embodiment, the pressure-fed fuel pressure achieved when the pressure control valve 47 of the pressure adjusting mechanism 40 has been narrowed based on the signal from the ECU is set to be about 400 kPa. Therefore, even if the engine temperature has incased to the vapor producible temperature, the production of vapor in the fuel is inhibited, and it is possible to inhibit fluctuation in the amount of fuel injected from the injectors 5. Therefore, it is possible to stabilize the idling rotational speed of the engine.

Thus, the water temperature gauge 3 and the ECU correspond to the vapor production determining means of the present invention, which determines whether or not the vapor of the fuel is producible, and the ECU corresponds to the control means of the present invention.

In addition, if the cooling water temperature of the engine detected by the water temperature gauge 3 becomes lower than the predetermined temperature (about 95° C.), the pressure control valve 47 of the pressure adjusting mechanism 40 is operated in an opening direction based on the signal from the ECU. Therefore, the flow passage area at the outlet port 423*p* of the control pressure chamber 423 of the pressure adjusting valve 42 increases to reduce the passage resistance. Hence, the fuel pressure within the control pressure chamber 423 of the pressure adjusting valve 42 decreases to cause the diaphragm 421 of the pressure adjusting valve 42 to receive the pressing force of the spring 423*s* disposed within the control pressure chamber 423. Therefore, the fuel pressure within the fuel pressure adjusting chamber 422 of the pressure adjusting valve 42 decreases to a pressure that balances with the pressing force of the spring 423*s* disposed within the control pressure chamber 423. Here, the fuel pressure within the fuel pressure adjusting chamber 422, i.e., the pressure-fed fuel pressure of the fuel supply apparatus 10, which balances with the pressing force of the spring 423*s*, is set to be about 150 kPa.

In this way, if the cooling water temperature of the engine becomes lower than the predetermined temperature (about 95° C.), the pressure-fed fuel pressure of the fuel supply apparatus 10 is lowered, and therefore, the electric power consumption by the fuel pump 30 is lowered, and at the same time, the loads on the pressure adjusting valve 42, the high-pressure filter 38, the tank-outside fuel supply pipe 7, etc., can be reduced.

Further, the fuel that has flown out of the control pressure chamber 423 of the pressure adjusting valve 42 due to the opening of the pressure control valve 47 of the pressure adjusting mechanism 40 is supplied to the vertical passage portion 25*t* of the jet pump 25, flows from the vertical passage portion 25*t* into the fuel inlet port 22 of the reservoir cup 20 via the nozzle portion 25*m*, and flows further into the reservoir cup 20 at a high speed. Hence, the fuel within the fuel tank flows from the fuel inlet port 22 into the reservoir cup 20 as it is drawn by the above-mentioned flow of the fuel. Hence, it leads that the fuel is always filled within the reservoir cup 20.

<Advantages of Fuel Supply Apparatus 10 According to This Embodiment>

With the fuel supply apparatus 10 according to this embodiment, if the cooling water temperature of the engine increases to a vapor producible temperature, the ECU operates the pressure control valve 47 to increase the pressure within the control pressure chamber 423 of the pressure adjusting valve 42 so as to increase the pressure of the fuel supplied to the injectors 5 insomuch as the production of vapor is inhibited. Thus, even if the engine temperature has increased to the vapor producible temperature, production of the vapor can be inhibited due to increase of the pressure of the fuel. Therefore, it is possible to inhibit fluctuation in the amount of fuel injected from the injectors 5 and to stabilize the idling rotational speed of the engine.

In addition, because it is configured such that the fuel discharged from the vapor discharge hole 32*b* of the fuel pump 30 is introduced into the control pressure chamber 423 of the pressure adjusting valve 42, it is possible to reduce the workload on the fuel pump 30, for example, in comparison with the construction in which a part of the fuel discharged from the pump discharge port 34*u* of the fuel pump 30 is introduced into the control pressure chamber 423. Therefore, the durability can be improved if the construction of the pump 30 is the same.

Further, within the fuel tank, the reservoir cup 20 for receiving the fuel pump 30 and the pressure adjusting mechanism 40 is installed at the bottom of the fuel tank, and the jet pump 25 is provided on the reservoir cup 20. The jet pump 25 causes the fuel flown out of the control pressure chamber 423 of the pressure adjusting valve 42 to flow into the reservoir cup 20 via the fuel inlet port 22 of the reservoir cup 20 so as to produce the flow of the fuel and to cause the fuel within the fuel tank to flow into the reservoir cup 20 by utilizing this flow of the fuel. Therefore, for causing the flow of the fuel within the fuel tank into the reservoir cup 20, it is possible to effectively utilize the kinetic energy of the fuel that has flown out of the control pressure chamber 423 of the pressure adjusting valve 42.

Further, the control pressure chamber 423 and the fuel pressure adjusting chamber 422 of the pressure adjusting valve 42 used in this embodiment have inlet ports 423*e* and 422*e* formed in the axial direction and have outlet ports 423*p* and 422*p* formed in the radial direction, and therefore, the fuel is hard to stay within the chambers, and it may not cause such a trouble that the aged fuel remains without being discharged.

Further, the pressure control valve 47 is disposed on the outlet side of the control pressure chamber 423 of the pressure control valve 42 and serves to narrow the flow passage to increase the passage resistance when it is intended to increase the pressure within the control pressure chamber 423. Hence, when the pressure within the control pressure chamber 423 is to be increased, the flow rate of the fuel flowing through the control pressure chamber 423 decreases, so that it is possible to reduce the workload on the fuel pump. As a result, the durability of the fuel pump is improved. Furthermore, when the device is used on the condition that the pressure within the control pressure chamber 423 of the pressure adjusting valve 42 is low (normal condition), the passage resistance is reduced to increase the flow rate of the fuel flowing through the control pressure chamber 423 due to the opening of the flow passage of the pressure control valve 47, so that the aged fuel is hard to stay within the control pressure chamber 423.

<Industrial Applicability 1>

The present invention may not be limited to the embodiment described above but may be modified without departing from the spirit of the present invention.

Here, in this Embodiment 1, the water temperature gauge 3 for measuring the temperature of the cooling water of the engine is exemplified as a sensor of the vapor production determining means for determining whether or not the fuel vapor is producible. However, it is possible to use a temperature sensor that detects the temperature inside of an intake air pipe of the engine in place of the water temperature gauge 3. Also, it is possible to use a temperature sensor that detects the temperature of the fuel, the temperature of engine oil or the temperature at the tip end of the injector in place of the water temperature gauge 3.

Further, without using the temperature sensor, it is possible to determine whether or not the vapor is producible, based on the increase in pressure within the delivery pipe 8, which may be caused by the production of vapor, by enabling the detection of the pressure within the delivery pipe 8 to which the injectors 5 have attached. Therefore, the delivery pipe 8 corresponds to the fuel pipe positioned proximal to the injector according to the present invention.

Furthermore, by measuring the current value of a motor that drives the fuel pump 32 and detecting the reduction in the load on the pump due to the production of vapor based on the reduction in the current value, it is possible to determine the production of vapor when the current value has reduced to be lower than a predetermined value.

Furthermore, although it is exemplified in Embodiment 1 that the fuel discharged from the vapor discharge hole 32*b* of the fuel pump 30 is introduced into the control pressure chamber 423 of the pressure adjusting valve 42, it is possible to introduce a part of the fuel discharged from the pump discharge port 34*u* of the fuel pump 30 into the control pressure chamber 423 of the pressure adjusting valve 42 via the reflux flow supply pipe 45 and the throttle 45*s* as shown in FIG. 2. This enables to increase the pressure of the fuel that is supplied from the control pressure chamber 423 of the pressure adjusting valve 42 to the jet pump 25. Hence, it is possible to increase the flow rate of the fuel that flows from the nozzle portion 25*m* of the jet pump 25 into the reservoir cup 20, so that the pumping performance for pumping the fuel from the fuel tank into the reservoir cup 20 can be improved.

Furthermore, it is exemplified in this embodiment that the pressure control valve 47 is provided in the reflux flow return pipe 46 and the pressure within the control pressure chamber 423 of the pressure adjusting valve 42 is increased or decreased by narrowing or broadening the flow passage on the outlet side of the control pressure chamber 423 of the pressure adjusting valve 42. However, as shown in FIG. 3, it is possible to increase or decrease the pressure within the control pressure chamber 423 of the pressure adjusting valve 42 by providing the pressure control valve 47 in the reflux flow supply pipe 45 and providing a throttle 46*f* in the reflux flow return pipe 46 in order to narrow broaden the flow passage on the inlet side of the control pressure chamber 423 of the pressure adjusting valve 42.

Furthermore, although the use of the pressure control valve 47 operable to take two positions on the opening side and the closing side is shown as an example in this embodiment, it is possible to use an adjusting valve that can continuously adjust an open area of the flow passage. Hence, it is possible to continuously adjust the pressure of the fuel supplied to the injectors 5 of the engine in response to the temperature of the cooling water of the engine.

Embodiment 2

Figure 4:
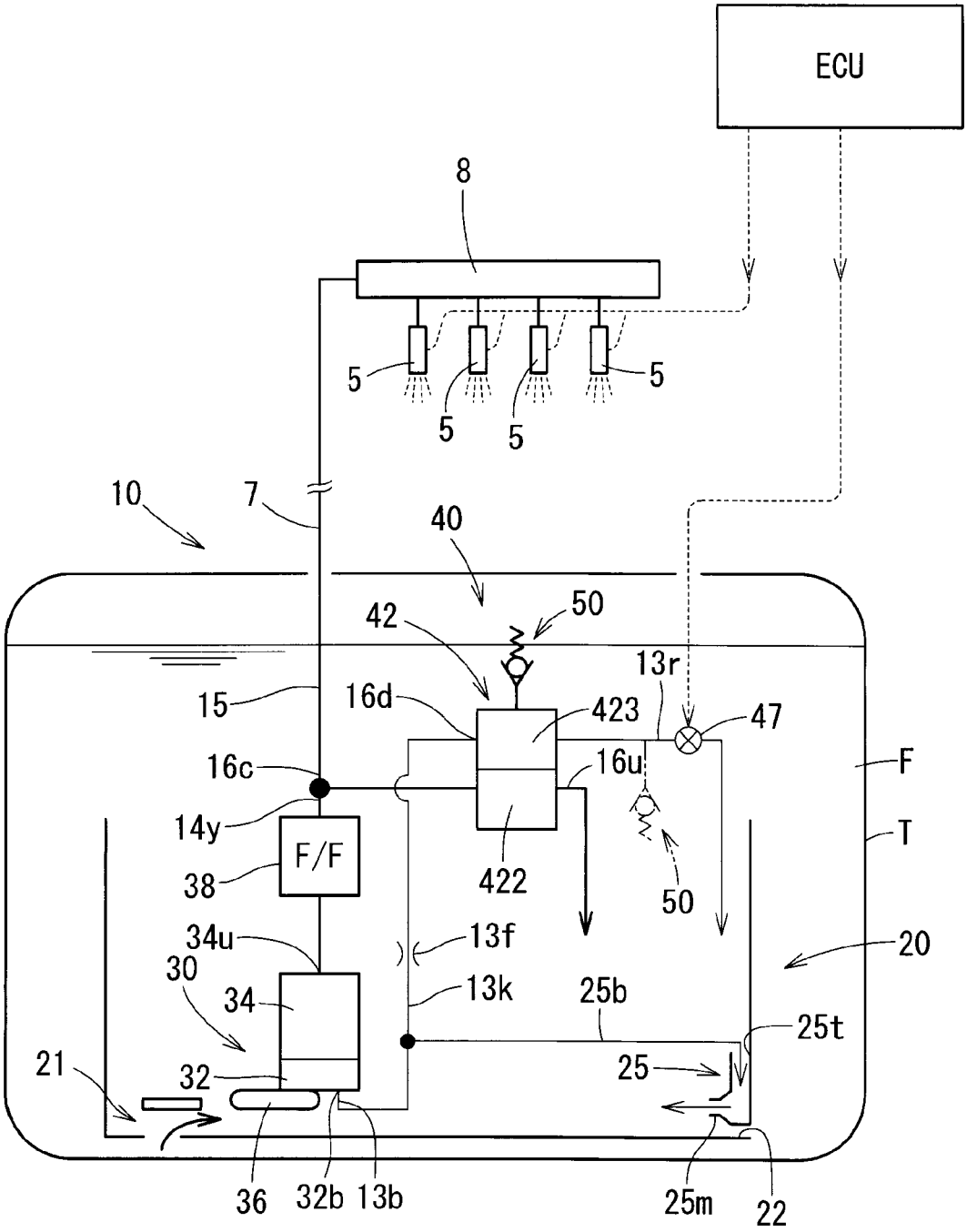
FIG. 4 This is a schematic view of a fuel supply apparatus according to the present invention (Embodiment 2).
Figure 5:
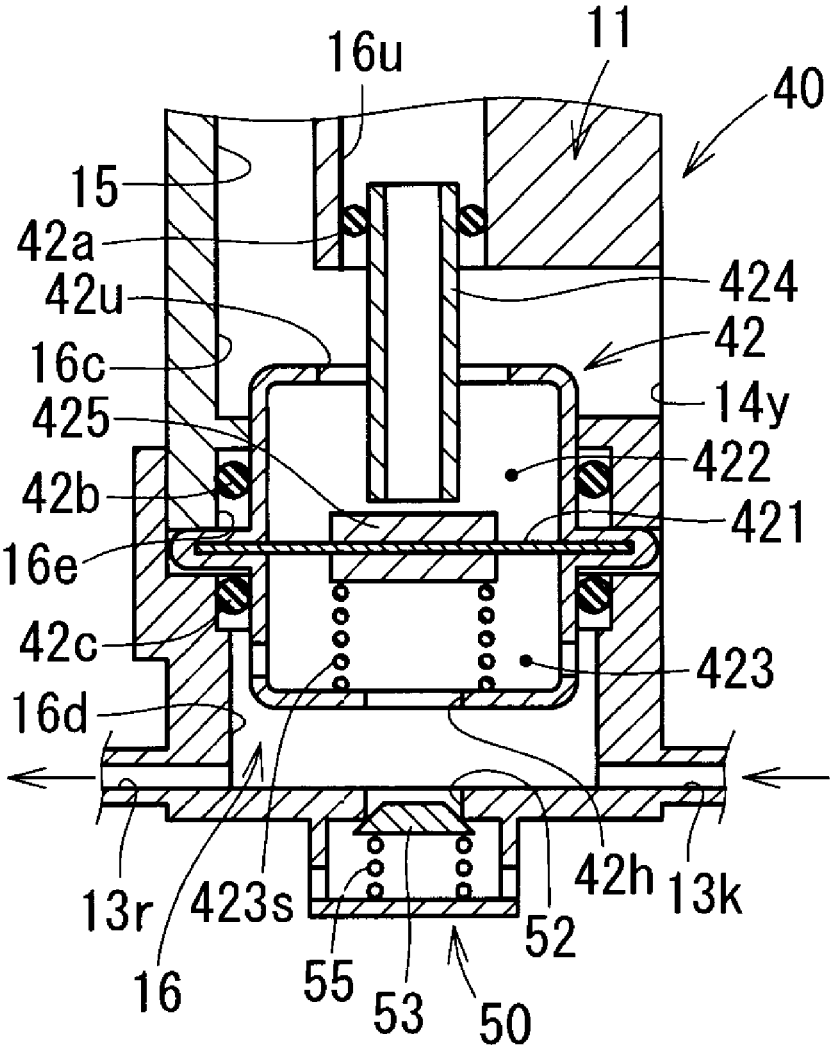
FIG. 5 This is a vertical sectional view showing a pressure adjusting mechanism of the fuel supply apparatus (Embodiment 2).
Figure 6:
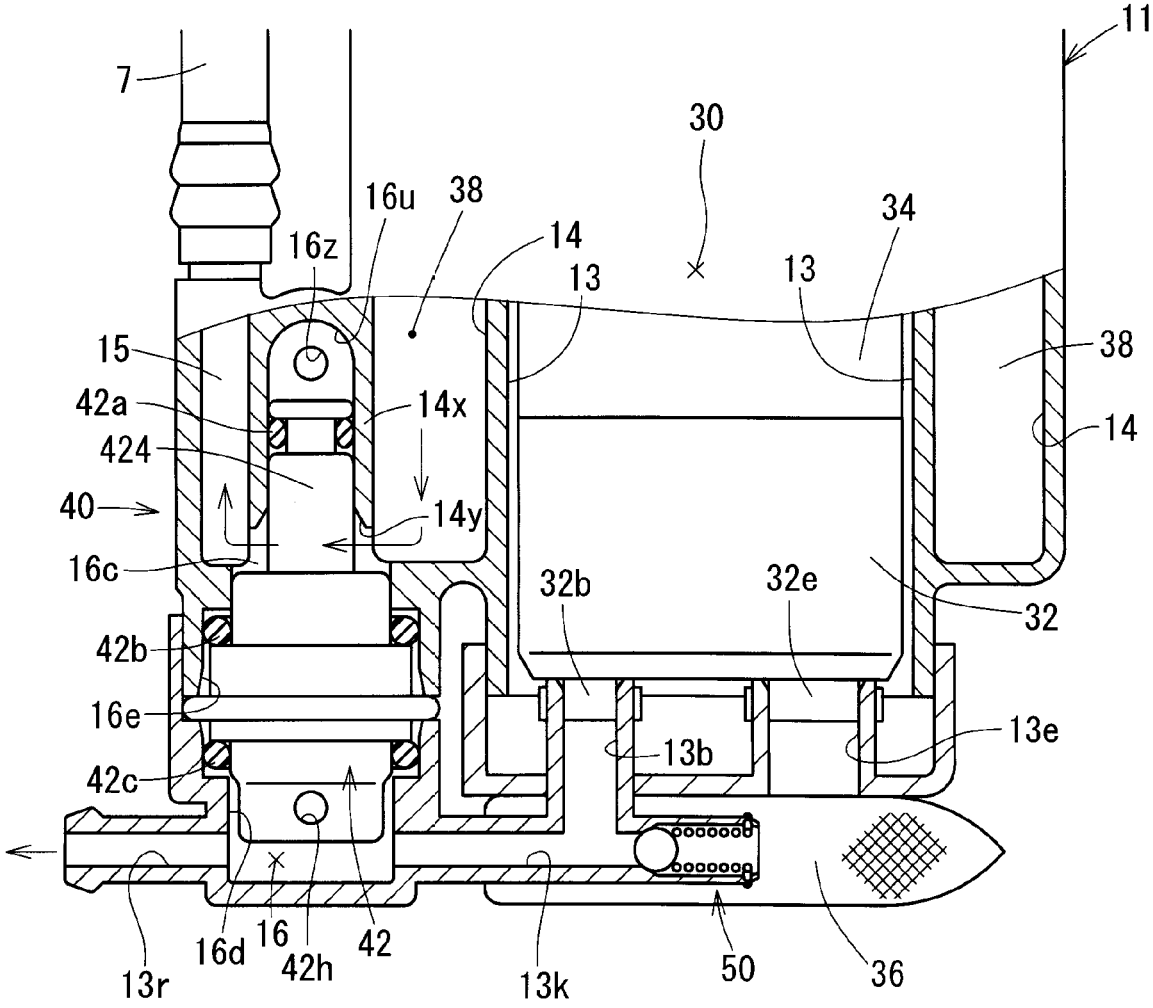
FIG. 6 This is a vertical sectional view of a receiving container for containing the pressure adjusting mechanism and a fuel pump, etc. (Embodiment 2).

A fuel supply apparatus according to Embodiment 2 of the present invention will now be describe based on FIGS. 4 to 11. The fuel supply apparatus of this embodiment is that mounted to a fuel tank installed mainly on a vehicle, such as an automobile, etc., and a schematic view of the fuel supply apparatus is shown in FIG. 4. FIG. 5 is a vertical sectional view showing a pressure adjusting mechanism of the fuel supply apparatus, and FIG. 6 is a vertical sectional view showing a receiving container for receiving the pressure adjusting mechanism, a fuel pump, etc. And, FIGS. 7 to 11 are schematic views showing alternative examples of the fuel supply apparatus, etc.

<Overall Structure of Fuel Supply Apparatus 10>

The fuel supply apparatus 10 of this embodiment is an apparatus for pressure-feeding fuel F within a fuel tank T to injectors 5 (fuel injection valves) of an engine. As shown in FIG. 4, the fuel supply apparatus 10 operates based on a signal from an engine control unit ECU (hereinafter called ECU) and includes a reservoir cup 20 configured as a top-open type container located at the bottom within the fuel tank T, a fuel pump 30 received within the reservoir cup 20, a suction filter 36, a high-pressure filter 38, and a pressure adjusting mechanism 40.

The fuel pump 30 is a motor-integrated type pump including an impeller-type pump section 32 for drawing, pressurizing and discharging the fuel, and a motor section 34 for driving the pump section 32, and is installed such that the pump section 32 is positioned on the lower side and the motor section 34 is positioned on the upper side. As shown in FIG. 6, the pump section 32 has a suction port 32*e* for drawing the fuel, and a suction filter 36 is attached to the suction port 32*e*. Therefore, the fuel within the reservoir cup 20 can be drawn into the pump section 32 from the suction port 32*e* via the suction filter 36. The fuel drawn into the pump section 32 from the suction port 32*e* is pressurized within a flow passage groove (not shown) by the rotation of the impeller (not shown) and is discharged into the motor section 34 from the discharge port (not shown). A vapor discharge hole 32*b* is formed with the flow passage groove of the pump section 32 at a midway position of the path from the suction port 32*e* to the discharge port for discharging the vapor in the fuel (i.e., gas bubbles that may be produced due to vaporization of the fuel) to the outside.

The fuel discharged into the motor section 34 from the pump section 32 cools within the motor section 34 as it flows therethrough upward, and at the same time, it lubricates and cleans the rotary portion, and is discharged from a pump discharge port 34*u* (see FIG. 4) provided at the upper end. A high-pressure filter 38 is connected to the pump discharge port 34*u*, and motor-derived foreign material, etc. contained in the fuel are captured by the high-pressure filter 38. After having filtered by the high-pressure filter 38, the fuel is adjusted to a predetermined pressure by the pressure adjusting mechanism 40, introduced to each of injectors 5 via a tank-outside fuel supply pipe 7 and a delivery pipe 8, and injected into combustion chambers (not shown) of the engine from injectors 5.

As shown in FIG. 6, the fuel pump 30, the high-pressure filter 38 and the pressure adjusting mechanism 40 are received within a receiving container 11, and the suction filter 36 is attached to the lower side of the receiving container 11.

<Receiving Container 11>

As shown in FIG. 6, the receiving container 11 has a fuel tank receiving section 13 having a cylindrical configuration at the central region, and a suction flow passage 13*e* for connecting to the suction port 32*e* of the fuel pump 30 and a vapor discharge flow passage 13*b* for connecting to the vapor discharge hole 32*b* of the fuel pump 30 are formed at the bottom of the fuel tank receiving section 13. The suction filter 36 is integrated with the receiving container 11 in the state where the suction filter 36 is connected to the suction flow passage 13*e* of the receiving container 11.

In addition, a filter receiving section 14 for receiving the high-pressure filter 38 is formed with the receiving container 11 and has a cylindrical configuration surrounding the fuel tank receiving section 13. Further, a pressure adjusting valve receiving chamber 16 for receiving a pressure adjusting valve 42 of the pressure adjusting mechanism 40 is defined on the radially outer side of the filter receiving section 14. The pressure adjusting valve receiving chamber 16 is separated into four chambers, i.e., an upper chamber 16*u*, a central upper chamber 16*c*, a central lower chamber 16*e* and a lower chamber 16*d*, by a first O-ring 42*a*, a second O-ring 42*b* and a third O-ring 42*c* that are attached to the outer circumferential surface of the pressure adjusting valve 42 in this order from the above. The central upper chamber 16*c* of the pressure adjusting valve receiving chamber 16 is in communication with the filter receiving section 14 (high-pressure filter 38) via a cut-out portion 14*y* of a wall portion 14*x*. Further, the central upper chamber 16*c* of the pressure adjusting valve receiving chamber 16 is in communication with the aforementioned tank-outside fuel supply pipe 7 via a fuel supply passage 15. Thus, the fuel discharged from the fuel pump 30 and passed through the high-pressure filter 38 is introduced into the central upper chamber 16*c* of the pressure adjusting valve receiving chamber 16 via the cut-out portion 14*y* and is introduced further from the central upper chamber 16*c* into the tank-outside fuel supply pipe 7 via the fuel supply passage 15 (see arrows).

In addition, the lower chamber 16*d* of the pressure adjusting valve receiving chamber 16 is connected to the vapor discharge hole 32*b* of the fuel pump 30 via a reflux flow supply passage 13*k* and the vapor discharge passage 13*b*. As shown in FIG. 4, a throttle 13*f* (not shown in FIG. 6) is provided in the midway of the reflux flow supply passage 13*k*, and a branch pipe 25*b* (not shown in FIG. 6) for supplying the fuel to a jet pump 25 that will be described later is also connected to the midway of the reflux flow supply passage 13*k*. Further, the lower chamber 16*d* of the pressure adjusting valve receiving chamber 16 is in communication with a reflux flow return passage 13*r* that is provided for returning the fuel into the fuel tank T, and a pressure control valve 47 is connected to the reflux flow return passage 13*r* (see FIG. 4). Therefore, it is configured such that the passage resistance can be adjusted on the outside side of the lower chamber 16*d* of the pressure adjusting valve receiving chamber 16 by the pressure control valve 47.

Further, as shown in FIG. 6, a pressure relief passage 16*z* for returning the surplus fuel into the fuel tank T is connected to the upper chamber 16*u* of the pressure adjusting valve receiving chamber 16.

<With Regard to Pressure Adjusting Mechanism 40>

The pressure adjusting mechanism 40 serves to adjust the pressure of the fuel discharged from the fuel pump 30 (the fuel filtrated by the high-pressure filter 38) and also serves to return the surplus high-pressure fuel into the fuel tank T (into the reservoir cup 20). The pressure adjusting mechanism 40 is provided with a pressure adjusting valve 42, flow passages 15, 13*r*, 13*k* and 16*z*, and the pressure control valve 47 mounted to the reflux flow return passage 13*r*.

As shown in FIG. 5, the pressure adjusting valve 42 is provided with a control pressure chamber 423 and a fuel pressure adjusting chamber 422 that are separated from each other in a vertical direction by a diaphragm 421. An upper opening 42*u* is formed in the upper chamber wall of the fuel pressure adjusting chamber 422, and the fuel passage adjusting chamber 422 is in communication with the central upper chamber 16*c* of the pressure adjusting valve receiving chamber 16 of the receiving container 11 via the upper opening 42*u*. As described previously, the central upper chamber 16*c* is in communication with the filter receiving section 14 (high-pressure filter 38) via the cut-out portion 14*y* of the wall portion 14*x* and is also in communication with the tank-outside fuel supply pipe 7 via the fuel supply passage 15. Therefore, the fuel pressure adjusting chamber 422 of the pressure adjusting valve 42 is in communication with the filter receiving section 14 (high-pressure filter 38), the fuel supply passage 15 and the tank-outside fuel supply pipe 7 via the central upper chamber 16*c*.

Thus, the cut-out portion 14*y* formed in the receiving container 11, the central upper chamber 16*c* of the pressure adjusting valve receiving chamber 16, the fuel supply passage 15, etc. correspond to the fuel supply passage that introduces the fuel discharged from the fuel pump into the tank-outside fuel supply pipe and is in communication with the fuel pressure adjusting chamber according to the present invention.

As shown in FIG. 5, a discharge pipe 424 extends through the upper opening 42*u* of the fuel pressure adjusting chamber 422 of the pressure adjusting valve 42, and one end of the discharge pipe 424 is open into the fuel pressure adjusting chamber 422. In addition, the other end of the discharge pipe 424 is open into the upper chamber 16*u* of the pressure adjusting valve receiving chamber 422 of the receiving container 11. Thus, the fuel pressure adjusting chamber 422 of the pressure adjusting valve 42 and the upper chamber 16*u* of the pressure adjusting valve receiving chamber 16 of the receiving container 11 are capable of communicating with each other via the discharge pipe 424.

A valve body 425 can close the opening of the discharge pipe 424 within the fuel pressure adjusting chamber 422 and is mounted to the diaphragm 421 that separates the fuel pressure adjusting chamber 422 and the control pressure chamber 423 from each other.

As shown in FIG. 5, the control pressure chamber 423 of the pressure adjusting valve 42 is configured to be able to press the diaphragm 421 toward the fuel pressure adjusting chamber 422 by the fuel pressure (high pressure) or a spring pressure (low pressure) and is in communication with the lower chamber 16*d* of the pressure adjusting valve receiving chamber 16 of the receiving container 11 via a plurality of openings 42*h* formed in the chamber wall. As described previously, the lower chamber 16*d* of the pressure adjusting valve receiving chamber 16 is connected to the vapor discharge hole 32*b* of the fuel pump 30 via the reflux flow supply passage 13*k* and the vapor discharge passage 13*b*. Further, the lower chamber 16*d* of the pressure adjusting valve receiving chamber 16 is in communication with the reflux flow return passage 13*r* for returning the fuel into the fuel tank T. Therefore, the control pressure chamber 423 of the pressure adjusting valve 42 is in communication with the reflux flow supply passage 13*k*, the vapor discharge passage 13*d* and the reflux flow return passage 13*r* via the lower chamber 16*d*.

Thus, the lower chamber 16*d* of the pressure adjusting valve receiving chamber 16 of the receiving container 11, the reflux flow supply passage 13*k*, the vapor discharge passage 13*b* and the reflux flow return passage 13*r* correspond to the fuel passage according to the present invention. In addition, the pressure control valve 47 connected to the reflux flow return passage 13*r* corresponds to the flow passage resistance adjusting means according to the present invention.

Within the control pressure chamber 423 of the pressure adjusting valve 42, a coil spring 423*s* is received for pressing the diaphragm 421 toward the fuel pressure adjusting chamber 422 and moving the valve body 425 in a direction of closing the opening of the discharge pipe 424. Therefore, if the fuel pressure within the control pressure chamber 423 has decreased to cause the pressing force of the coil spring 423*s* (predetermined value) to exceed the fuel pressure, only the pressing force of the coil spring 423*s* (predetermined value) is applied to the diaphragm 421. Thus, the spring force of the coil spring 423*s* corresponds to the predetermined value according to the present invention. On the contrary, if the fuel pressure within the control pressure chamber 423 has increased to exceed the pressing force of the coil spring 423*s* (predetermined value), the diaphragm 421 is pressed toward the fuel pressure adjusting chamber 422 by the pressure of the fuel.

Here, if the force of pressing the diaphragm 421 from the side of the control pressure chamber 423 exceeds the force of pressing the diaphragm 421 from the side of the fuel pressure adjusting chamber 422, the diaphragm 421 is flexed upward and the valve body 425 moves upward, so that the size of clearance between the valve body 425 and the discharge pipe 424 (the flow passage area of the valve body 425) decreases. Hence, the passage resistance increases to cause increase in the fuel pressure within the fuel pressure adjusting chamber 422, so that the fuel pressure within the tank-outside fuel supply pipe 7, etc., that is in communication with the fuel pressure adjusting chamber 422 increases.

On the contrary, if the force of pressing the diaphragm 421 from the side of the fuel pressure adjusting chamber 422 exceeds the force of pressing the diaphragm 421 from the side of the control pressure chamber 423, the diaphragm 421 is flexed downward and the valve body 425 moves downward, so that the size of clearance between the valve body 425 and the discharge pipe 424 (the flow passage area of the valve body 425) increases. Hence, the passage resistance decreases to cause decrease in the fuel pressure within the fuel pressure adjusting chamber 422, so that the fuel pressure within the tank-outside fuel supply pipe 7, etc., that is in communication with the fuel pressure adjusting chamber 422 decreases.

As shown in FIG. 5, a relief valve 50 is disposed below the lower chamber 16*d* of the pressure adjusting valve receiving chamber 16 of the receiving container 11 for releasing a part of the fuel into the reservoir cup 20 when the fuel pressure within the lower chamber 16*d* and the control pressure chamber 423 of the pressure adjusting valve 42 has increased to be equal to or more than a set value. The relief valve 50 is constituted by a passage 52 formed in the lower wall of the lower chamber 16*d* of the pressure adjusting valve receiving chamber 16, a valve member 53 that can open or close the passage 52, and a spring material 55 that presses the valve member 53 in a direction of closing the passage 52 by a fixed force.

Although the relief valve 50 is disposed below the lower chamber 16*d* of the pressure adjusting valve receiving chamber 16 in the example shown in FIG. 5, it is possible to dispose the relief valve 50 at a corner portion between the reflux flow supply passage 13*k* communicating with the lower chamber 16*d* and the vapor discharge passage 13*b* as shown in FIG. 6. Further, as indicated by dotted lines in FIG. 4, it is possible to provide the relief valve 50 in the reflux flow return passage 13*r*.

<With Regard to Jet Pump 25>

The jet pump 25 is a pump that is adapted to cause the fuel within the fuel tank T to flow into the reservoir cup 20 by using the flow of the fuel. As shown in FIG. 4, the jet pump 25 is provided with a vertical passage portion 25*t* disposed vertically along a vertical wall of the reservoir cup 20 and is also provided with a nozzle portion 25*m* that is formed at the lower end of the vertical passage portion 25*t* so as to be oriented laterally and perpendicularly relative to the vertical passage portion 25*t*. The nozzle portion 25*m* of the jet pump 25 is inserted into a fuel inlet port 22 of the reservoir cup 20. Here, the inner diameter of the fuel inlet port 22 is set to be larger than the outer diameter of the nozzle portion 25*m*, and therefore, it is configured such that the nozzle portion 25*m* does not close the fuel inlet port 22. In addition, the previously mentioned branch pipe 25*b* communicating with the vapor discharge hole 32*b* of the fuel pump 30 is connected to the upper end of the vertical passage portion 25*t*. Therefore, if the fuel discharged from the vapor discharge hole 32*b* is supplied to the jet pump 25 via the branch pipe 25*b*, the fuel is supplied from the nozzle portion 25*m* to the fuel inlet port 22 of the reservoir cup 20 at a high flow speed. Then, it causes that the fuel within the fuel tank T is drawn by the flow of the fuel and flows from the fuel inlet port 22 into the reservoir cup 20.

A check valve 21 is disposed at the bottom of the reservoir cup 20, and therefore, the fuel within the fuel tank T can flow into the reservoir cup 20 via the check valve 21.

<With Respect to Operation of Fuel Supply Apparatus 10>

The operation of the fuel supply apparatus 10 of this embodiment will now be described.

With the fuel supply apparatus 10 of this embodiment, the pressure control valve 47 of the pressure adjusting mechanism 40 is controlled in a direction to narrow the flow passage based on the signal from the ECU, for example, when the engine is started. Thus, referring to FIGS. 5 and 6, the flow rate of the fuel flowing through reflux flow return passage 13*r* decreases, so that the flow of the fuel out of the lower chamber 16*d* of the pressure adjusting valve receiving chamber 16 is restricted. Hence, the fuel discharged from the vapor discharge hole 30*b* of the fuel pump 30 flows through the vapor discharge passage 13*b* and the reflux flow supply passage 13*k* and is stored within the lower chamber 16*d* of the pressure adjusting valve receiving chamber 16 and the control pressure chamber 423 of the pressure adjusting valve 42. Then, the fuel pressure within the control pressure chamber 423 of the pressure adjusting valve 42 increases to a pressure substantially equal to the fuel pressure within the vapor discharge hole 32*b* of the fuel pump 30. Hence, the diaphragm 421 is flexed upward as viewed in FIG. 5 to decrease the size of clearance (flow passage area of the valve body 425) between the valve body 425 attached to the diaphragm 421 and the discharge pipe 424. As a result, the passage resistance increases to cause increase of the fuel pressure within the fuel pressure adjusting chamber 422.

At that time, if the output of the fuel pump 30 increases to increase the flow rate of the discharge fuel due to raise in the battery voltage, the flow rate of the fuel flowing from the fuel pressure adjusting chamber 422, flowing through the clearance between the valve body 425 and the discharge pipe 424 (flow passage of the valve body 425), and then returning to the reservoir cup 20 through the discharge pie 424, etc. gradually increases. Hence, the diaphragm 421 receives a force that causes the diaphragm 421 to be flexed downward, so that the fuel pressure within the control pressure chamber 423 and the fuel pressure adjusting chamber 422 increases.

However, if the fuel pressure within the lower chamber 16*d* of the pressure adjusting valve receiving chamber 16 and the fuel pressure within the control pressure chamber 423 of the pressure adjusting valve 42 increases to exceed a set value, the relief valve 50 operates to release a part of the fuel within the control pressure chamber 423 into the reservoir cup 20. Hence, the fuel pressure within the control pressure chamber 423 of the pressure adjusting valve 42 is maintained at the set value.

As a result, the fuel pressure within the fuel pressure adjusting chamber 422 of the pressure adjusting valve 42 is adjusted to a pressure corresponding to the fuel pressure (set value) of the control pressure chamber 423, so that the pressure of fuel within the passage from the tank-outside fuel supply pipe 7 to the injectors 5, which passage communicates with the fuel pressure adjusting chamber 422 via the central upper chamber 16*c* and the fuel supply passage 15, becomes to be substantially equal to the pressure within the fuel pressure adjusting chamber 422.

Here, if the pressure of the fuel supplied to the injectors 5 increases and the fuel pressure within the fuel pressure adjusting chamber 422 exceeds a pressure (high set pressure) corresponding to the fuel pressure within the control pressure chamber 423, the force of pressing the diaphragm 421 from the side of the fuel pressure adjusting chamber 422 becomes larger than the force of pressing the diaphragm 421 from the side of the control pressure chamber 423. Hence, the diaphragm 421 is flexed downward, the valve body 435 moves downward, and the flow passage area (size of clearance between the valve body 425 and the discharge pipe 424) increases. Hence, the passage resistance decreases, the fuel pressure within the fuel pressure adjusting chamber 422 is lowered, and the fuel pressure within the tank-outside fuel supply pipe 7, etc. communicating with the fuel pressure adjusting chamber 422 is lowered.

In this way, because the flow passage area (size of clearance between the valve body 425 and the discharge pipe 424) is adjusted, the passage resistance is adjusted, and the fuel pressure within the tank-outside fuel supply pipe 7, etc. communicating with the fuel pressure adjusting chamber 422 is adjusted to be a high set pressure. Thus, because the pressure of the fuel supplied to the injectors 5 is maintained at a high set pressure, atomization of the injected fuel is enhanced, and the startability of the engine is improved.

If the rotation of the engine is stabilized after the engine has started on the condition that the fuel pressure is adjusted to a high set pressure, the pressure control valve 47 of the pressure adjusting mechanism 40 then operates to an open direction based on the signal from the ECU. Hence, the passage resistance on the outlet side of the lower chamber 16*d* of the pressure adjusting valve receiving chamber 16 decreases, and the fuel pressure within the control pressure chamber 423 of the pressure adjusting valve 42 is lowered. If the pressure of the fuel within the control pressure chamber 423 is lowered below a predetermined value, the diaphragm 421 receives a pressing force of the spring 423*s* within the control pressure chamber 423. Hence, the fuel pressure within the fuel pressure adjusting chamber 422 of the pressure adjusting valve 42 is lowered to a low set pressure that balances with the pressing force of the spring 423*s* within the control pressure chamber 423 as described above. Hence, the fuel pressure within the tank-outside fuel supply pipe 7, etc. communicating with the fuel pressure adjusting chamber 422 of the pressure adjusting valve 42 is lowered to a low set pressure, so that it is possible to reduce the load on the fuel pump 102, etc.

<Advantages of Fuel Supply Apparatus 10 According to this Embodiment>

With the fuel supply apparatus 10 according to this embodiment, if the fuel pressure within the control pressure chamber 423 of the pressure adjusting valve 42 raises to exceed a predetermined value (spring force of the coil spring 423*s*) by the operation of the pressure control valve 47, the fuel pressure within the fuel pressure adjusting chamber 422, i.e., the pressure of the fuel supplied to the injectors, is adjusted to a high pressure to correspond to the fuel pressure within the control pressure chamber 423. Here, for example, if the output of the fuel pumps 30 is increased to cause increase of the flow rate of the discharge fuel due to the raise of the battery voltage, the flow rate of the fuel flowing from the fuel pressure adjusting chamber 422, flowing through the clearance between the valve body 425 and the discharge pipe 424 (flow passage of the valve body 425), and returning to the reservoir cup 20 via the discharge pipe 424, etc. gradually increases. Hence, the diaphragm 421 receives a force that forces the diaphragm 421 to be flexed downward, and the fuel pressure within the control pressure chamber 423 and the fuel pressure adjusting chamber 422 increases. However, if the fuel pressure within the control pressure chamber 423 is increased to exceed a set value, the relief valve 50 operates to release a part of the fuel within the control pressure chamber 423 into the reservoir cup 20, and the fuel pressure within the control pressure chamber 423 is maintained at the set value.

The pressure adjusting valve 42 adjusts the fuel pressure within the fuel pressure adjusting chamber 422 depending on the fuel pressure within the control pressure chamber 423, and therefore, the pressure within the fuel pressure adjusting chamber 422 is maintained at a fixed pressure because the fuel pressure within the control pressure chamber 423 is maintained at the set value. Hence, the fuel pressure within the tank-outside fuel supply pipe 7 communicating with the fuel pressure adjusting chamber 422 (the pressure of the fuel supplied to the injectors 5) is maintained at a fixed pressure. Thus, if the flow rate of the fuel discharged from the fuel pump 30 is changed when the fuel pressure supplied to the injectors 5 is changed to a high pressure, the fuel pressure is hard to change, and the pressure adjusting performance is improved.

In addition, because the throttle 13*f* is provided in the reflux flow supply passage 13*k* (fuel passage) positioned upstream side of the control pressure chamber 423 of the pressure adjusting valve 42, it is possible to reduce the flow rate of the fuel supplied to the control pressure chamber 423 and to reduce the load on the fuel pump 30. Further, the throttle 13*f* does not badly affect to the discharge of vapor.

In addition, because it is configured such that the fuel discharged from the vapor discharge hole 32*b* of the fuel pump 30 is introduced into the control pressure chamber 423 of the pressure adjusting valve 42, it is possible to reduce the workload on the fuel pump 30, for example, in comparison with the construction in which a part of the fuel discharged from the pump discharge port 34 of the fuel pump 30 is introduced into the control pressure chamber 423. Therefore, if the construction of the pump 30 is not changed, the durability can be improved.

Further, the fuel pump 30, the high-pressure filter 38 and the pressure adjusting mechanism 40 are received within the receiving container 11, and the flow passages interconnecting the fuel pump 30, the high-pressure filter 38 and the pressure adjusting mechanism 40 are formed in the chamber walls of the receiving container 11. Therefore, there is no need of piping connection sections that are required on the side of the pressure adjusting mechanism 40 (pressure adjusting valve 42) in the case of the arrangement where the flow passages are constituted by pipes, and it is possible to simplify the configuration of the pressure adjusting valve 42. Further, because there is no need of a piping space around the pressure adjusting mechanism 40, the fuel supply apparatus 10 becomes compact.

<Industrial Applicability 2>

The present invention may not be limited to Embodiment 2 described above but may be modified without departing from the spirit of the present invention.

Figure 7A:
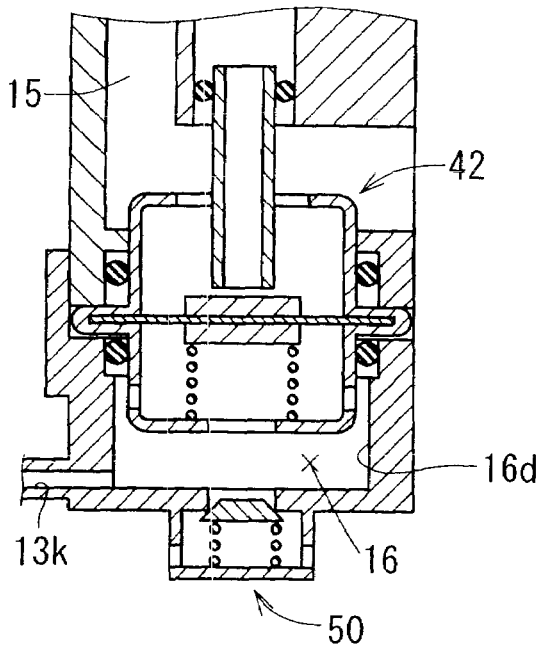
FIGS. 7(A) and 7(B) These are a vertical sectional view showing a pressure adjusting mechanism according to an alternative example of the fuel supply apparatus (FIG. 7A) and a vertical sectional view of the receiving container (FIG. 7B) (Embodiment 2).
Figure 7B:
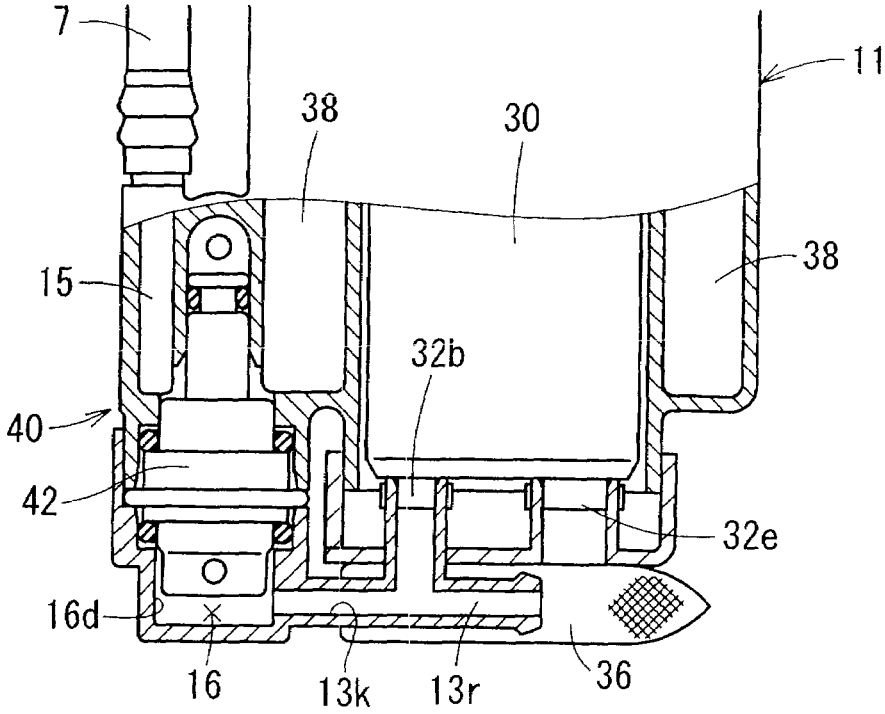

With the fuel supply apparatus 10 according to this embodiment, as shown in FIGS. 5 and 6, it is exemplified that the reflux flow supply passage 13*k* and the reflux flow return passage 13*r* are connected to the lower chamber 16*d* of the pressure adjusting valve receiving chamber 16 of the receiving container 11 at positions opposing to each other with respect to the center thereof. However, as shown in FIGS. 7(A)(B), it is possible to configure such that only the reflux flow supply passage 13*k* is connected to the lower chamber 16*d* of the pressure adjusting valve receiving chamber 16 and the reflux flow return passage 13*r* is branched from the midway of the reflux flow supply passage 13*k*. In FIG. 7(B), the relief valve 50 is omitted.

Further, with the fuel supply apparatus 10 according to Embodiment 2, it is exemplified that the relief valve 50 is provided in the passage communicating with the control pressure chamber 423 of the pressure adjusting valve 42 in order to prevent the fuel pressure within the control pressure chamber 423 from increasing to exceed the set value. However, as shown in FIG. 8, it is possible to provide the relief valve 50 in a flow passage positioned on the upstream side of the tank-outside fuel supply pipe 7 (see solid line position and dotted line position) in order to prevent the pressure of the fuel supplied to the injectors 5 from increasing to exceed the set value.

Figure 8:
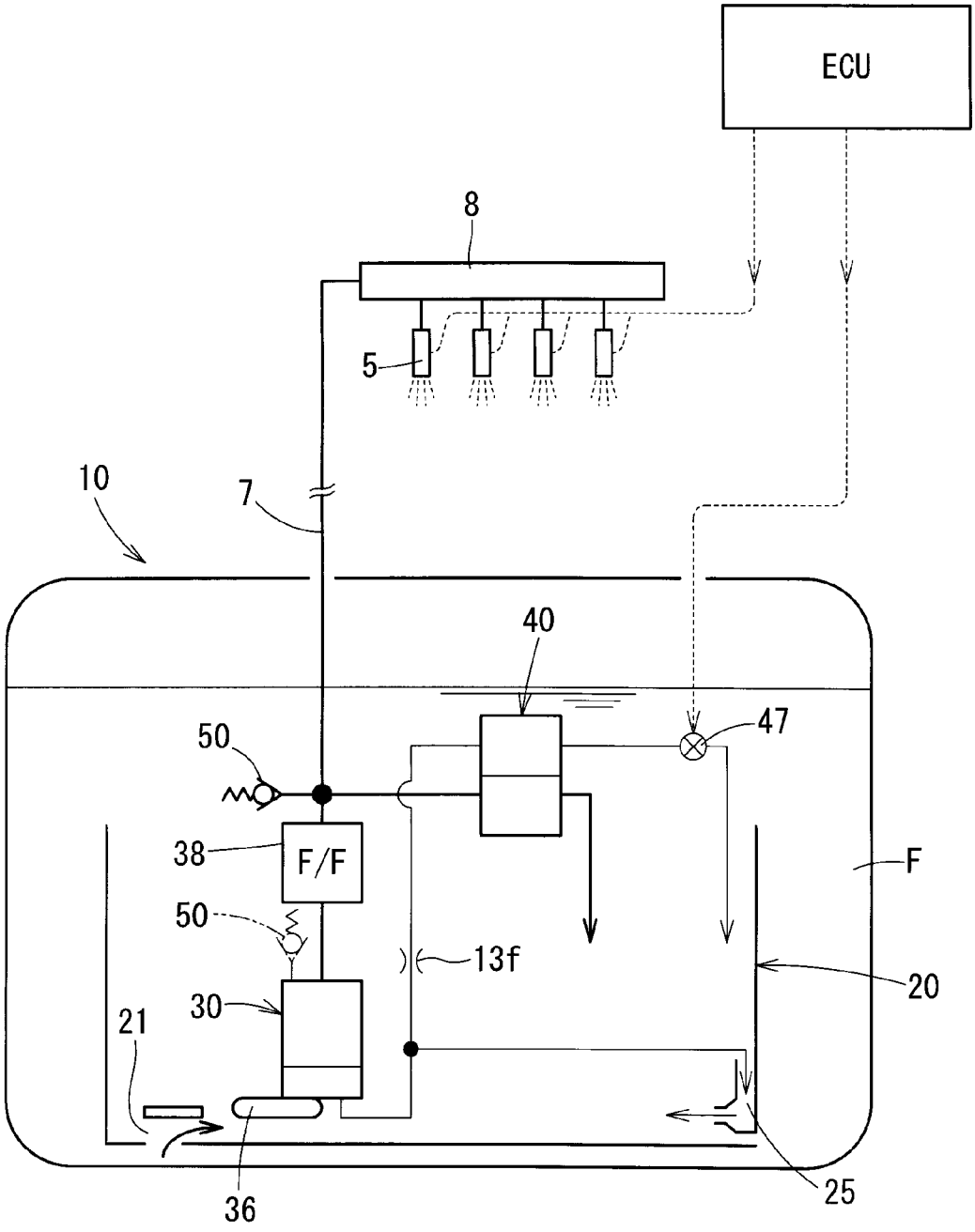
FIG. 8 This is a schematic view of an alternative example of the fuel supply apparatus.
Figure 9:
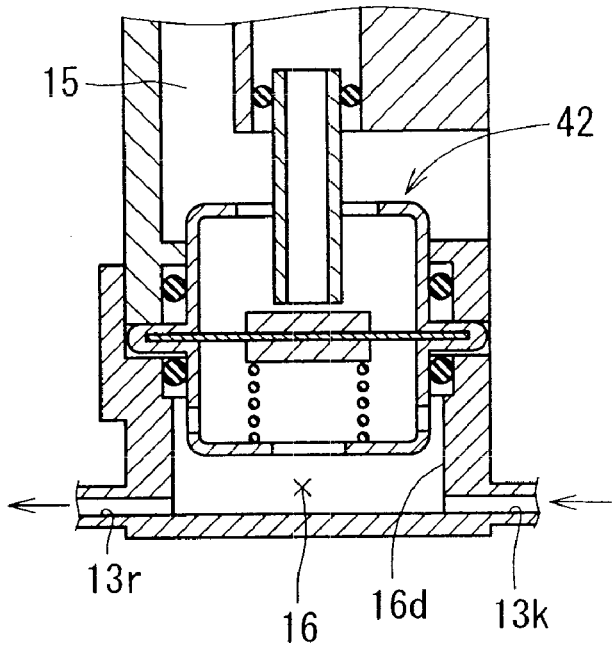
FIGS. 9(A) and 9(B) These are vertical sectional views (FIG. 9A, FIG. 9B) showing a pressure adjusting mechanism of an alternative example of the fuel supply apparatus (Embodiment 2).
Figure 9:
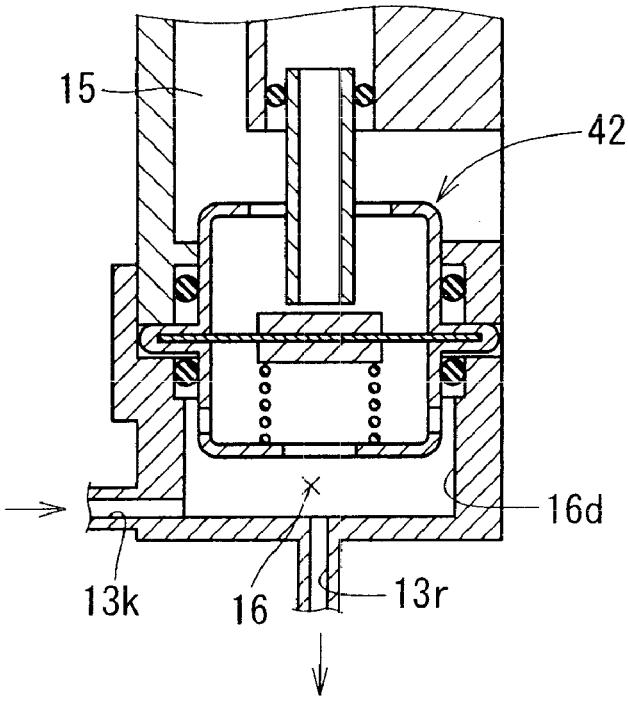

In the case that the relief valve 50 is provided at a position communicating with the tank-outside fuel supply pipe 7 as shown in FIG. 8, no relief valve 50 is necessary to be provided on the side of the lower chamber 16*d* of the pressure adjusting valve receiving chamber 16 of the receiving container 11 as shown in FIGS. 9(A)(B). Hence, it is possible to connect the reflux flow return passage 13*r* in a vertical direction to cause the fuel to flow downward from the lower chamber 16*d* of the pressure adjusting valve receiving chamber 16 (see FIG. 9(B)). Hence, the fuel can be easily removed from within the lower chamber 16*d* of the pressure adjusting valve receiving chamber 16, and the aged fuel is hard to stay without being removed.

In addition, as shown in FIG. 8, the pressure control valve 47 is disposed on the outlet side of the control pressure chamber 423 of the pressure adjusting valve 42 and serves to narrow the flow passage when it is intended to increase the pressure of the control pressure chamber 423. Therefore, when the pressure of the control pressure chamber 423 is increased, the flow rate of the fuel flowing through the control pressure chamber 423 decreases, and hence, it is possible to reduce the workload on the fuel pump 30. As a result, the durability of the fuel pump 30 is improved. Further, when the control pressure chamber 423 of the pressure adjusting valve 42 is used at a low pressure condition (normal condition), the pressure control valve 47 opens the flow passage, and therefore, the flow rate of the fuel flowing through the control pressure chamber 423 increases, and the aged fuel is hard to stay within the control pressure chamber 423.

Figure 10:
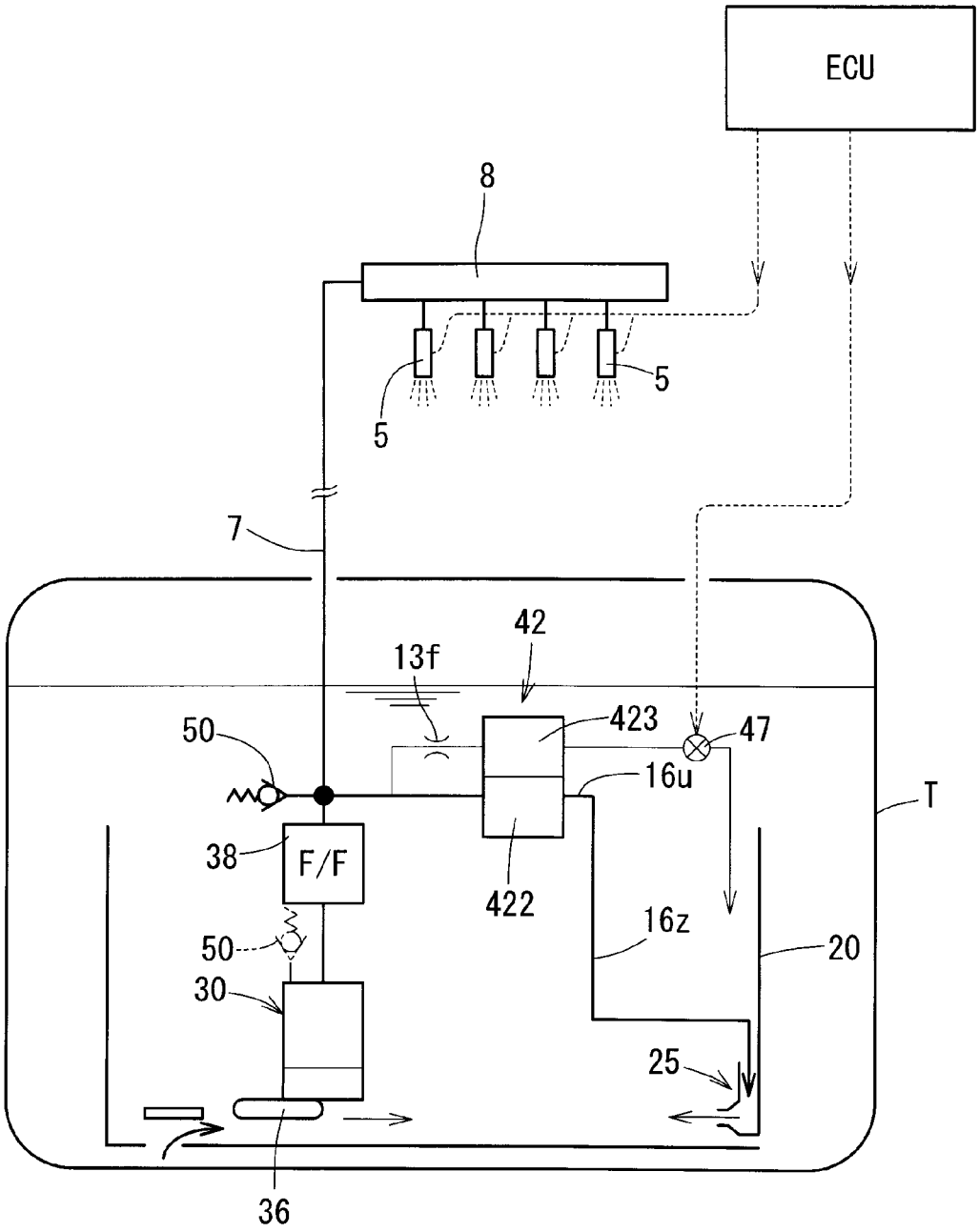
FIG. 10 This is a schematic view of an alternative example of the fuel supply apparatus (Embodiment 2).
Figure 11:
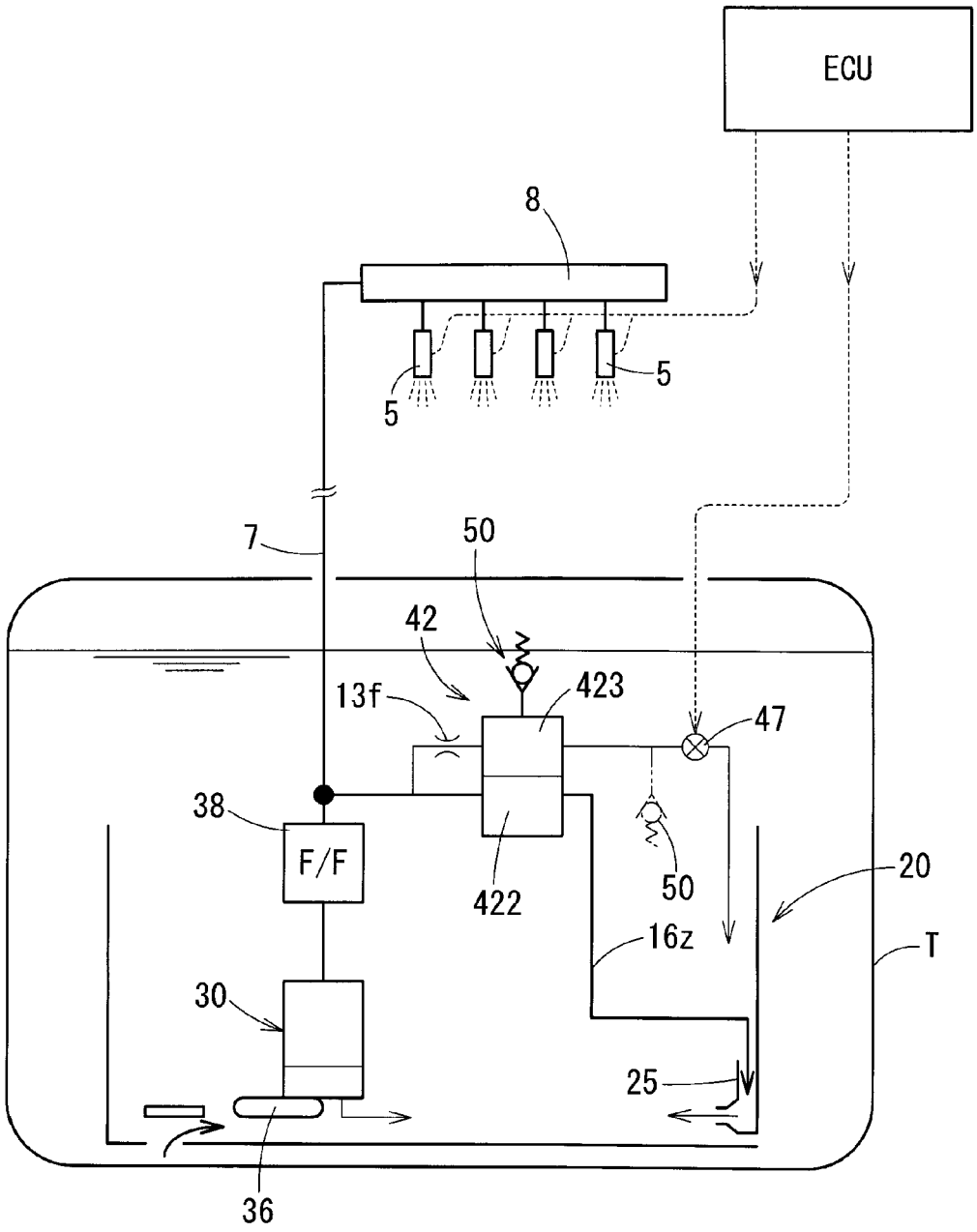
FIG. 11 This is a schematic view of an alternative example of the fuel supply apparatus (Embodiment 2).
Figure 12:
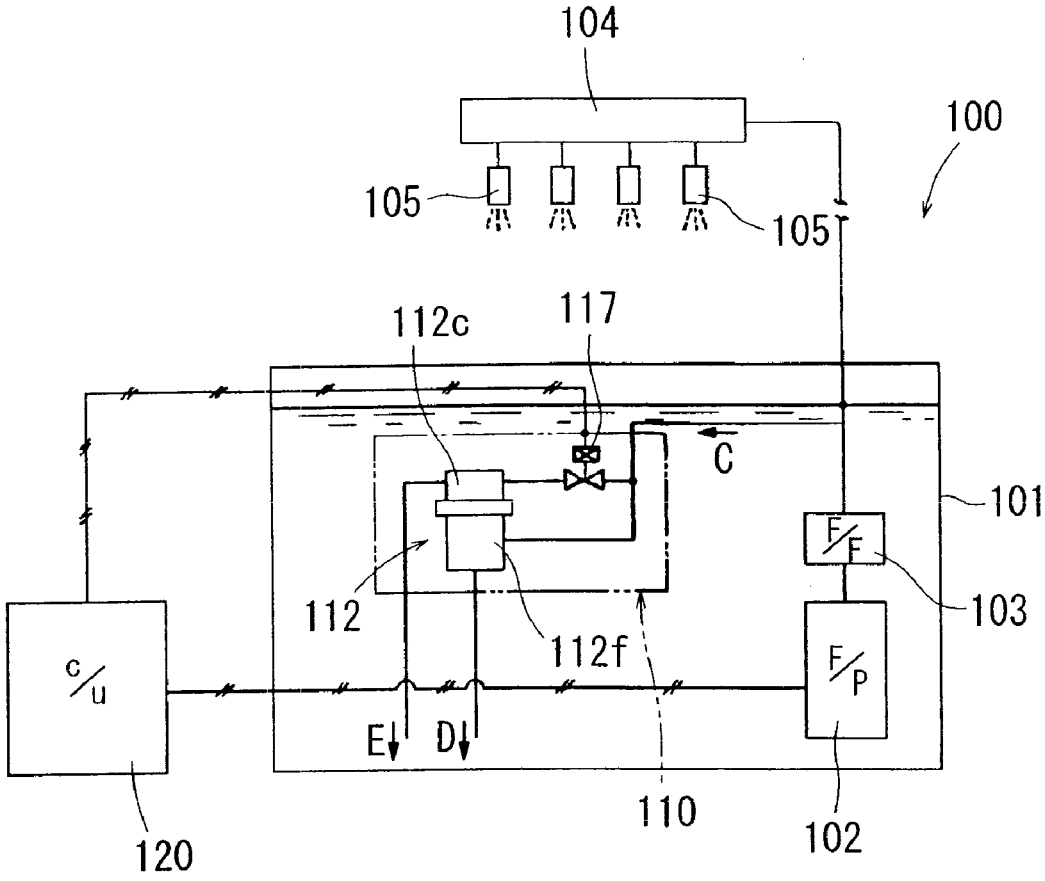
FIG. 12 PRIOR ART
FIG. 12 This is a schematic view of a fuel supply apparatus according to a prior art embodiment.

Furthermore, with the fuel supply apparatus 10 according to Embodiment 2, it is exemplified that the fuel discharged from the vapor discharge hole 32*b* of the fuel pump 30 is introduced into the control pressure chamber 423 of the pressure adjusting valve 42 (see FIGS. 4 and 8). However, as shown in FIGS. 10 and 11, it is possible to configure such that a part of the fuel discharged from the fuel pump 30 (the fuel that has passed through the high-pressure filter 38) is introduced into the control pressure chamber 423 of the pressure adjusting valve 42 via the throttle 13*f*. In such a case, the relief valve 50 may be provided in a flow passage positioned on the upstream side of the tank-outside fuel supply pipe 7 as shown in FIG. 10 or may be positioned in a flow passage communicating with the control pressure chamber 423 of the pressure adjusting valve 42 as shown in FIG. 11.

Furthermore, although it is exemplified in Embodiment 2 that a part of the fuel discharged from the vapor discharge hole 32*b* of the fuel pump 30 is supplied to the jet pump 25, the fuel that returns from the fuel adjusting chamber 422 of the pressure adjusting valve 42 to the reservoir cup 20 via a pressure relief passage 16*z* can be supplied to the jet pump 25 as shown in FIGS. 10 and 11.

Furthermore, although it is exemplified in Embodiment 2 that the fuel pressure is set to be a high pressure when starting the engine and that the fuel pressure is set to be a low pressure after starting the engine, it is possible to set the fuel pressure to be a high pressure when the engine is at a high-temperature.

The invention claimed is:

1. A fuel supply apparatus comprising: a fuel tank;

a fuel pump located within the fuel tank and connected to an injector of an engine;

a tank-outside fuel supply pipe disposed externally of the fuel tank;

a pressure adjusting mechanism constructed to adjust a pressure of a fuel discharged from the fuel pump, so that the fuel adjusted in pressure by the pressure adjusting mechanism is supplied to the injector via the tank-outside fuel supply pipe;

wherein the pressure adjusting mechanism comprises:

a control pressure chamber;

a fuel passage capable of introducing the fuel, which is pressurized by the fuel pump but is not supplied to the injector, into the control pressure chamber and returning the fuel flowing out of the control pressure chamber into the fuel tank, a passage resistance adjusting device disposed on a downstream side of the control pressure chamber, and constructed to adjust a passage resistance against flow of the fuel through the fuel passage; and a fuel pressure adjusting chamber communicating with the tank-outside fuel supply pipe;

wherein the passage resistance adjusting device is operable to set the fuel pressure within the fuel pressure adjusting chamber according to the pressure within the control pressure chamber, so that the pressure within the fuel pressure adjusting chamber can be increased to set a high pressure value for the fuel pressure within the tank-outside fuel supply pipe wherein the fuel discharged from a discharge hole formed along a pump passage of the fuel pump is introduced into the control pressure chamber via the fuel passage.

2. The fuel supply apparatus as in claim 1, wherein:

the passage resistance adjusting device is operable to set the fuel pressure within the fuel pressure adjusting chamber to a first pressure when the fuel pressure within the control pressure chamber is higher than a predetermined value; and wherein the passage resistance adjusting device is operable to set the fuel pressure within the fuel pressure adjusting chamber to a second pressure lower than the first pressure when the fuel pressure within the control pressure chamber is lower than the predetermined value.

3. The fuel supply apparatus as in claim 1, wherein:

the passage resistance adjusting device is operable to set the fuel pressure within the fuel pressure adjusting chamber to a first pressure when the fuel is supplied into the control pressure chamber under pressure; and wherein the passage resistance adjusting devise is operable to set the fuel pressure within the fuel pressure adjusting chamber to a second pressure lower than the first pressure when no pressurized fuel is supplied into the control pressure chamber.

4. The fuel supply apparatus as in claim 1, wherein the pressure adjusting mechanism further comprises:

a relief valve capable of releasing a part of the fuel from at least one of the control pressure chamber and the fuel pressure adjusting chamber, so that a maximum limit of the pressure within the fuel pressure adjusting chamber can be defined by the relief valve.

5. The fuel supply apparatus as in claim 1, wherein:

the relief is valve disposed in the control pressure chamber of the pressure adjusting mechanism or in the fuel passage communicating with the control pressure chamber.

6. The fuel supply apparatus as defined in claim 5, further comprising a throttle provided in the fuel passage on the upstream side of the control pressure chamber.

7. The fuel supply apparatus as defined in claim 5, further comprising:

a fuel supply passage constructed to introduce the fuel discharged from the fuel pump into the tank-outside fuel supply pipe and to communicate with the fuel pressure adjusting chamber of the pressure adjusting mechanism; and a container constructed to receive the pressure adjusting mechanism therein;

wherein the fuel supply passage is formed within a wall of the container.

8. The fuel supply apparatus as in claim 7, wherein the fuel pump is received within the container.

9. The fuel supply apparatus as in claim 1, wherein:

the discharge hole is formed midway along the pump passage.

10. A fuel supply apparatus comprising:

a fuel tank;

a fuel pump located within the fuel tank and connected to as injector of an engine;

a tank-outside fuel supply pipe disposed externally of the fuel tank;

a pressure adjusting mechanism constructed to adjust a pressure of a fuel discharged from the fuel pump, so that the fuel adjusted in pressure by the pressure adjusting mechanism is supplied to the injector via the tank-outside fuel supply pipe;

wherein the pressure adjusting mechanism comprises:

a control pressure chamber;

a fuel passage capable of introducing the fuel, which is pressurized by the fuel pump but is not supplied to the injector, into the control pressure chamber and returning the fuel flowing out of the control pressure chamber into the fuel tank, a passage resistance adjusting device constructed to adjust a passage resistance against flow of the fuel through the fuel passage; and a fuel pressure adjusting chamber communicating with the tank-outside fuel supply pipe;

wherein the passage resistance adjusting device is operable to set the fuel pressure within the fuel pressure adjusting chamber according to the pressure within the control pressure chamber; and a relief valve capable of releasing a part of the fuel from at least one of the control pressure chamber and the fuel pressure adjusting chamber, so that a maximum limit of the pressure within the fuel pressure adjusting chamber can be defined by the relief valve, wherein the relief is valve disposed in the control pressure chamber of the pressure adjusting mechanism or in the fuel passage communicating with the control pressure chamber, and the fuel discharged from a discharge hole formed along a pump passage of the fuel pump is introduced into the control pressure chamber via the fuel passage.

11. the fuel supply apparatus as defined in claim 10, wherein the discharge hole is a vapor discharge hole.

12. The fuel supply apparatus as in claim 10, wherein:

the discharge hole is formed midway along the pump passage.

* * * * *